US008610639B2

(12) United States Patent
Podduturi

(10) Patent No.: US 8,610,639 B2
(45) Date of Patent: Dec. 17, 2013

(54) SURFACE-INDEPENDENT BODY MOUNT CONFORMAL ANTENNA

(75) Inventor: Bharadvaj R. Podduturi, Pleasant Hill, CA (US)

(73) Assignee: World Products LLC, Sonoma, CA (US)

( * ) Notice: Subject to any disclaimer, the term of this patent is extended or adjusted under 35 U.S.C. 154(b) by 500 days.

(21) Appl. No.: 12/879,678

(22) Filed: Sep. 10, 2010

(65) Prior Publication Data

US 2011/0057855 A1 Mar. 10, 2011

Related U.S. Application Data

(60) Provisional application No. 61/276,259, filed on Sep. 10, 2009.

(51) Int. Cl.
*H01Q 1/42* (2006.01)

(52) U.S. Cl.
USPC ..... 343/872; 343/700 MS; 343/848

(58) Field of Classification Search
USPC ..... 343/700 MS, 702, 872, 848
See application file for complete search history.

(56) References Cited

U.S. PATENT DOCUMENTS 4,700,194 A * 10/1987 Ogawa et al. ..... 343/700 MS
6,307,508 B1 * 10/2001 Nagasawa ..... 343/700 MS
6,842,142 B2 * 1/2005 Takesako et al. ..... 343/700 MS
6,940,463 B2 9/2005 Ittipiboon et al.
7,183,983 B2 2/2007 Ozden
2003/0052824 A1 * 3/2003 Ollikainen et al. .... 343/700 MS
2004/0160370 A1 * 8/2004 Ghosh et al. ..... 343/702
2006/0145923 A1 7/2006 Autti
2006/0234657 A1 * 10/2006 Boyle ..... 455/129
2008/0211721 A1 9/2008 Ohba et al.

FOREIGN PATENT DOCUMENTS

JP 2005-117082 4/2005
JP 2006-245869 9/2006
KR 10-2007-0018511 4/2007

* cited by examiner

*Primary Examiner* — Dieu H Duong

(74) *Attorney, Agent, or Firm* — Patterson Thuente Pedersen, P.A.

(57) ABSTRACT

A surface-independent antenna that operates consistently and independently of a material of its mounting surface. The antenna includes a ground plane having an outer perimeter, an antenna element having a floating portion and a non-floating portion. The non-floating portion is affixed in a generally parallel orientation above an end of the ground plane, and the floating portion extends beyond the outer perimeter of the ground plane. The antenna also includes a housing including a top portion and a bottom portion, the housing sized to generally encapsulate the ground plane and the antenna element.

17 Claims, 26 Drawing Sheets

SURFACE-INDEPENDENT BODY MOUNT CONFORMAL ANTENNA

RELATED APPLICATION

The present application claims priority to U.S. Provisional Application No. 61/276,259 filed on Sep. 10, 2009, which is herein incorporated by reference in its entirety.

FIELD OF THE INVENTION

The present invention relates generally to conformal antennas. More particularly, the present invention relates to multiband, body mount conformal antennas exhibiting high performance characteristics independent of the surface onto which the antenna is mounted.

BACKGROUND OF THE INVENTION

The performance of a typical antenna may be greatly affected by the surface onto which it is mounted. Therefore, most antenna designs take into account the material of the surface onto which the antenna will be mounted. For example, a typical antenna that will be placed onto a metal box may be designed for optimal performance knowing that the metal box will affect the operation of the antenna. However, if that same antenna is placed on a wooden box, or in free space, the antenna will operate in a much different, non-optimal, way.

Further, conformal antennas on metals, in general, tend to provide relatively poor performance with very weak efficiencies (less than 40%). Patch antennas, in contrast, exhibit good efficiency numbers while being very conformal, but they suffer from the drawback that the peak gains usually are higher than 4 or 5 dBi. Such a peak gain causes problems for FCC compliance purposes. Peak gain of patch antennas can be reduced by reducing their efficiencies, such that patch antennas have very poor performance. Designing multiband antennas is also a big challenge for patch antennas. Patch antennas are not omni-directional and are not favored in applications where RF power needs to be distributed adequately in all directions.

Therefore, for applications requiring high-performance, multiband operation, patch antennas are usually not an option. Even more difficult are those same applications where the antenna may be mounted on a variety of surface materials.

SUMMARY OF THE INVENTION

In one embodiment, the present invention is a surface-independent, multiband conformal body-mount antenna that provides optimal performance on any given surface. The antenna includes a ground plane, and an antenna element having a floating portion and a non-floating portion. The non-floating portion is adjacent and above an end of the ground plane, and the floating portion is not adjacent the ground plane. The antenna also includes a housing having a top portion and a bottom portion, the bottom portion including a projection forming a space to receive the floating portion of the antenna element.

In another embodiment, the antenna of the present invention operates consistently and independently of a material of the mounting surface and includes a ground plane having an outer perimeter; an antenna element having a floating portion and a non-floating portion, including an antenna trace having a high-band arm and a low-band arm. The non-floating portion is affixed in a generally parallel orientation above an end of the ground plane, and the floating portion extends beyond the outer perimeter of the ground plane. The antenna also includes a via block disposed between the ground plane and the antenna element, including at least one via oriented generally perpendicular to the antenna element, wherein the at least one via is in proximity to the low-band arm of the antenna trace, and a ground pill attached to the ground plane in non-contact proximity to the high-band arm of the antenna trace. The antenna also includes a housing including a top portion and a bottom portion, the housing sized to generally encapsulate the ground plane and the antenna element, and wherein the bottom portion of the housing includes a projection forming a space to receive the floating portion of the antenna element.

Embodiments of the present invention also include methods for mounting an antenna to a mounting surface, including the steps of mounting a ground plane adjacent the mounting surface, positioning an antenna element in a plane substantially parallel to, and above the ground plane, such that a portion of the antenna element is adjacent the ground plane and the mounting surface, and a portion of the antenna is not adjacent the ground plane and the mounting surface.

The above summary of the various embodiments of the invention is not intended to describe each illustrated embodiment or every implementation of the invention. The figures in the detailed description that follow more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
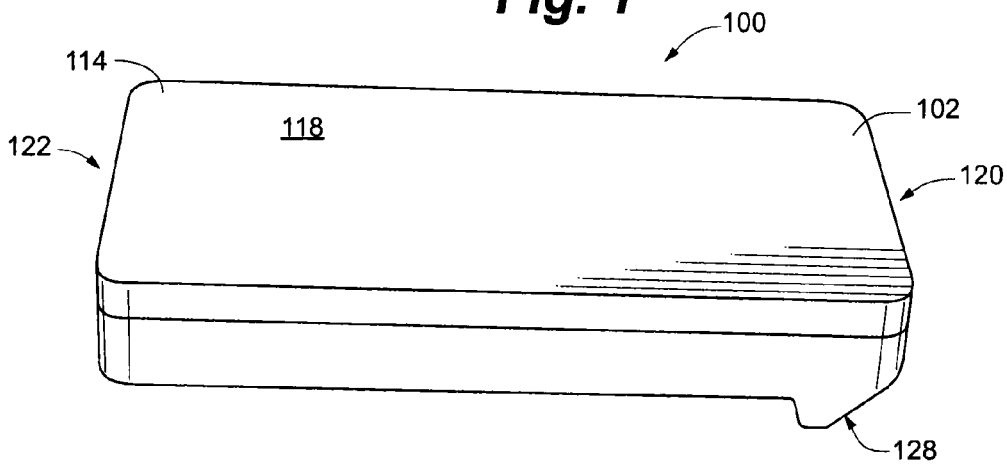
FIG. 1 is a top perspective view of an antenna according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 2:
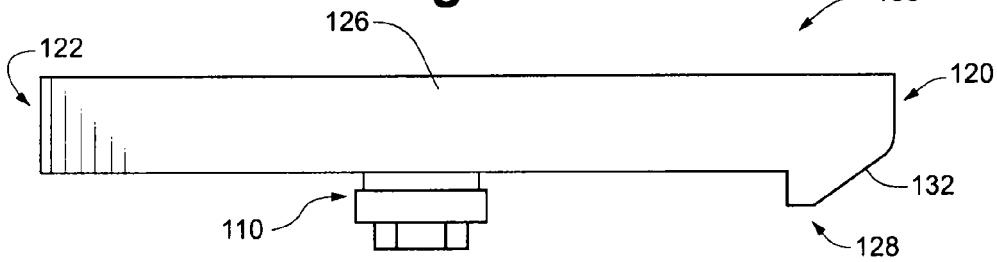
FIG. 2 is a right-side elevational view of the antenna of FIG. 1.
Figure 3:
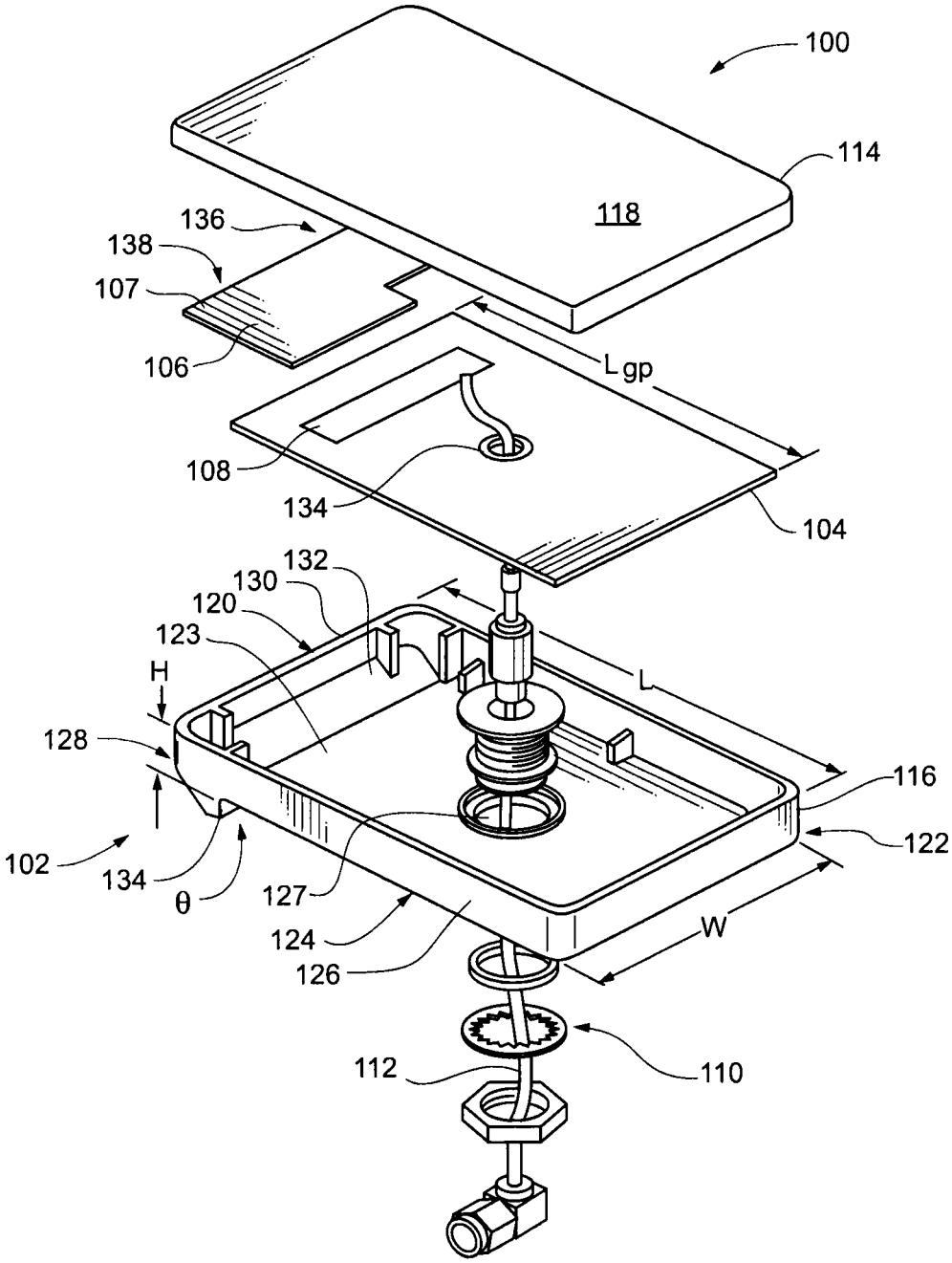
FIG. 3 is an exploded view of an embodiment of the antenna of FIG. 1.

Referring to FIGS. 1 and 2, an assembled embodiment of antenna 100 is depicted in FIGS. 1 and 2, while an exploded view of antenna 100 is provided in FIG. 3. In the depicted embodiment, antenna 100 includes a housing 102, ground plane 104, antenna element 106, support coupler 108, connector assembly 110, and signal wire 112.

As depicted in FIGS. 1-3 and 5-6, housing 102 may be generally rectangular, with a length L, width W and height H, such that length L is longer than width W. In some embodiments, such as when antenna 100 is to be used in a restricted space, it may be advantageous to have a minimized height H, where height H is less than width W. In one exemplary embodiment, housing 102 length L is 95 mm, width W is 60 mm, height H is 14 mm, and projection height is 19 mm. Housing 102 may be made of any of a variety of materials, such as one of many known types of plastic.

Housing 102 includes a top portion 114 and a bottom portion 116. In an embodiment, top portion 114 includes a top surface 118; bottom portion 116 includes first end 120, second end 122, bottom wall 123, bottom surface 124, and in some embodiments, sidewalls 126. Bottom portion 116 further defines aperture 127. In one exemplary embodiment aperture 127 is approximately 10 mm by 12 mm, and located approximately in the center of bottom portion 116.

First end 120 of housing bottom portion 116 can include projection 128 formed of front wall 130, optional sloping wall 132, lower wall 134, and a portion of sidewalls 126. Projection 128 traverses first end 120 in a direction parallel to width W, and projects downward and away from bottom surface 124. In an embodiment, projection 120 forms an angle θ, which in an embodiment is 90°, with bottom wall 123. In other embodiments, projection 128 may take other shapes, including an embodiment where front wall 130 extends further than that depicted in FIGS. 1-3, and without sloping wall 132. In yet other embodiments, projection 128 may not traverse the entire width W of bottom portion 116, but may only traverse a portion of width W.

Referring to FIG. 3, ground plane 104 comprises a piece of generally flat, rectangular, conducting material, and is shaped to fit within housing 102. In an embodiment, length Lgp of ground plane 104 may be shorter than length L of bottom housing 116 such that none, or only a portion, of ground plane 104 projects beyond bottom wall 123 and over projection 128 (refer also to FIG. 4 discussed in more detail below). Ground plane 104 may also form aperture 134 through which signal wire 112 can pass.

Referring to FIGS. 3 and 7*a*-9, in an embodiment, antenna element 106 comprises a generally flat, conductive material, such as a copper trace, supported by a rigid support material, such as a printed circuit board (PCB). A surface area of antenna element 106 may be significantly smaller than a surface area of ground plane 104. As is depicted in FIG. 3, antenna 106 may be generally rectangular in shape, and traverse all or a portion of width W of bottom housing 116.

Figure 8:
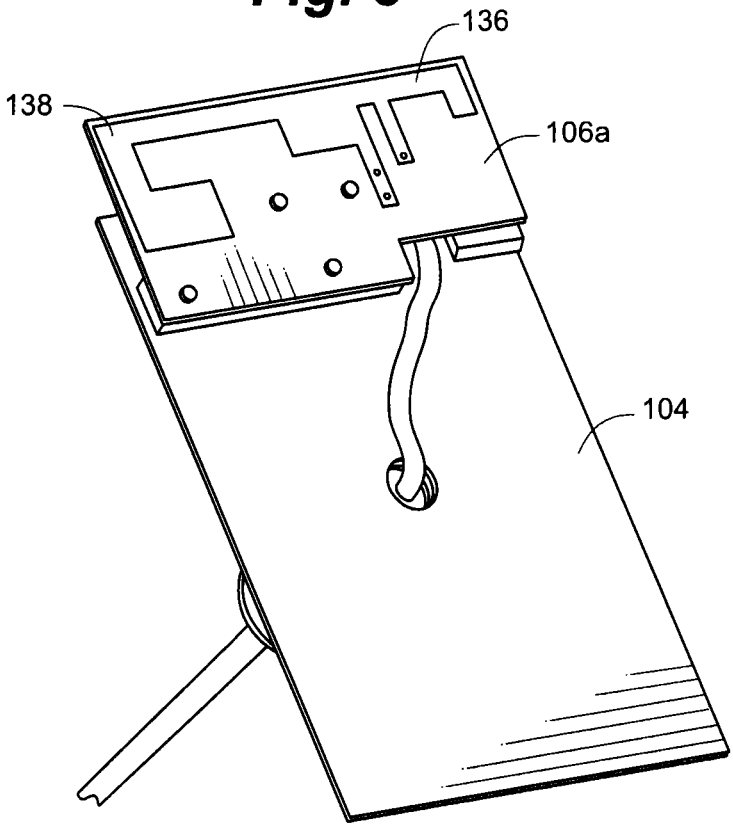
FIG. 8 is a perspective view of an antenna element positioned over a ground plane, of an embodiment of the invention.
Figure 9:
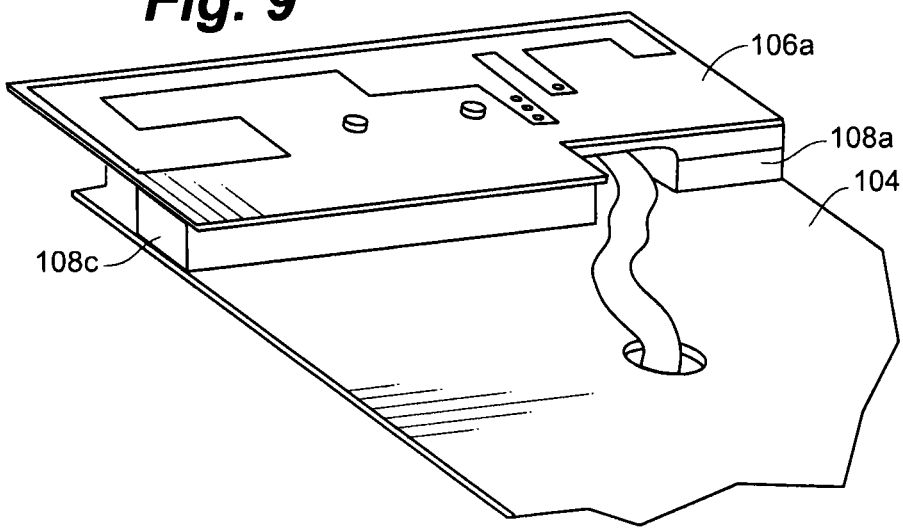
FIG. 9 is a perspective view of an antenna element positioned over a ground plane, of an embodiment of the invention.

In a multiband embodiment of antenna 100, antenna element may comprise a trace having a high-band arm 136 and a low-band arm 138, with the low-band arm being somewhat larger in size than the high-band arm, depending on the high and low frequencies of operation. In some embodiments, antenna 106, though generally rectangular, forms an L-shape. As depicted in FIGS. 8-9, the antenna element including high-band arm 136 and low-band arm 138 of antenna element 106*a* can vary in shape and width.

Referring again to FIGS. 3 and 8-9, support coupler 108 is a shim-like device located between ground plane 104 and antenna 106, and affixed to both. In some embodiments, support coupler 108 comprises an insulative material, a dielectric material, a conductive material, or a combination of these three. For example, in an embodiment, support coupler 108 may comprise stacked pieces of printed circuit boards, or other rigid, insulating materials. Dielectric, conductive and combination embodiments of support coupler 108 are discussed further below, and in reference to FIGS. 22-25.

Referring to FIGS. 2-4, and 7*b* connector assembly 110 can include a number of fasteners, washers, gaskets, and other connector portions, such that it may accept a variety of cables and wires, including RG178, RG174, or RG316 cables, standard coaxial cables, micro-coaxial cables, and so on. Though not an exhaustive list, connector assembly 110 may comprise any of the following connector styles: TNC R TNC, RA SMA (male), SMA (male), RAMCX (male), RA MMCX (male) RA SMA (female), and so on. Signal wire 112 can be any of known signal conducting wire types for use with antennas.

Figure 4:
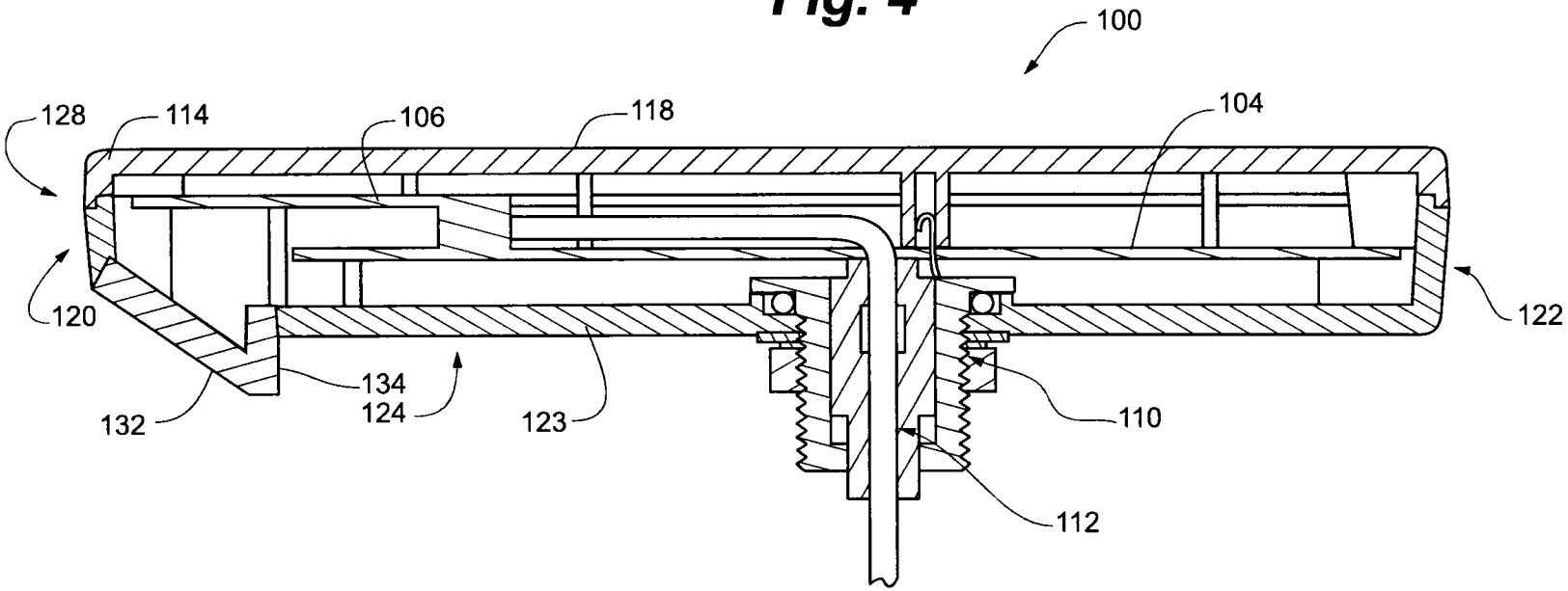
FIG. 4 is a cross-sectional view of an embodiment of the antenna of FIG. 1.
Figure 5:
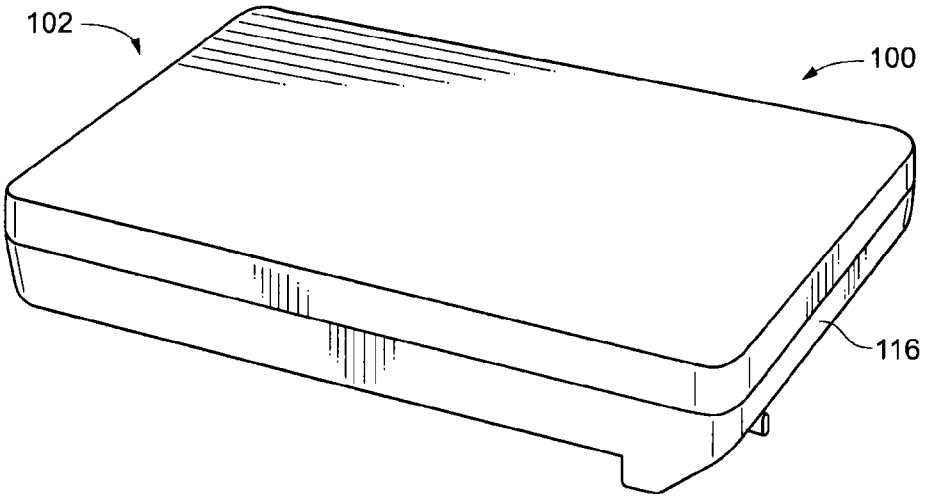
FIG. 5 is a perspective view of an antenna according to an embodiment of the invention.
Figure 6:
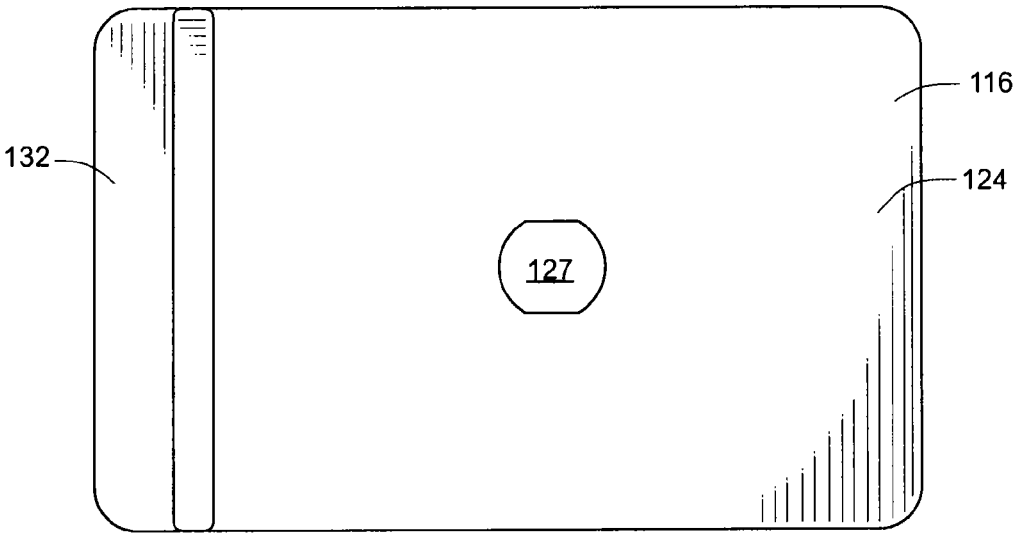
FIG. 6 is a bottom view of an antenna according to an embodiment of the invention.
Figure 7A:
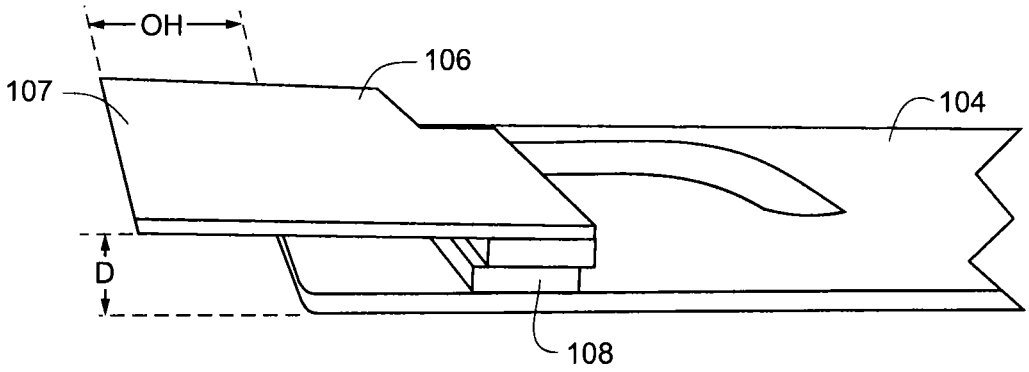
FIG. 7*a* is a left-side perspective view of an antenna element positioned over a ground plane, of an embodiment of the invention.

Referring specifically to FIGS. 7*a* and 8, when assembled, antenna element 106 is affixed to ground plane 104 by way of support coupler 108, such that antenna element 106 is positioned above ground plane 104 at a distance D. The distance D may vary from embodiment to embodiment. Antenna element 106 is also positioned relative to ground plane 104 such that a portion of antenna element 106, floating portion 107, is not positioned over ground plane 104. A portion of antenna element 106 that is not positioned above ground plane 104, floating portion 107, projects beyond an end of ground plane 104 by a distance OH. Distance OH may vary from embodiment to embodiment. In one embodiment OH is a distance of approximately 3 mm. FIGS. 4 and 8-9 also depict the relative position of antenna element 106/106*a* and ground plane 104.

Referring again to FIGS. 3 and 4, when assembled, ground plane 104 seats into bottom portion 116 such that it does not project into the space formed by projection 128. However, a portion of antenna element 106 can project into the space formed above projection 128, such that projection sloping wall 132 is located directly below the portion of antenna 106. In one embodiment the floating portion 107 extends into the spaced defined by projection 128 by approximately the distance OH.

Further, when assembled, connector assembly 110 connects and secures ground plane 104 to housing 102, which in turn secures antenna element 106. Signal wire 112 projects through connector assembly 112, through aperture 134 for connection to antenna element 106 and/or ground plane 104, depending on the particular antenna design and signal wire 112. Top portion 114 seats onto bottom portion 116 of housing 102 to form an enclosed antenna 100.

Figure 10:
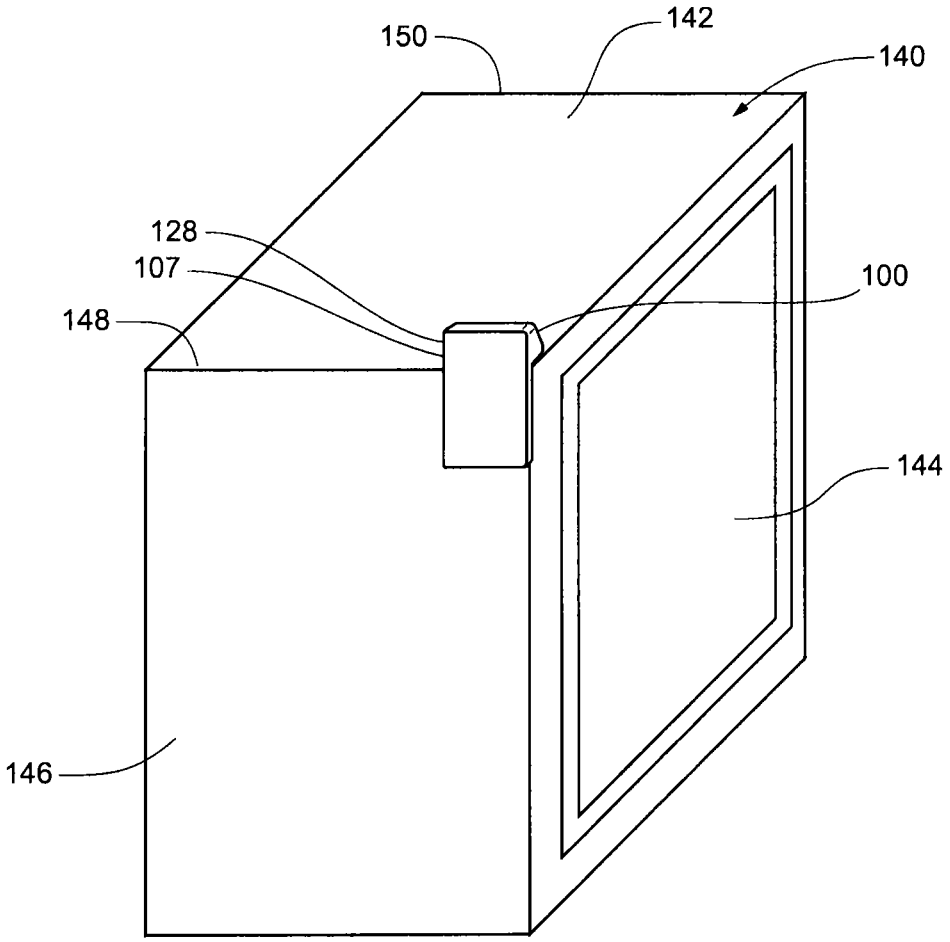
FIG. 10 is a perspective view of the antenna of FIG. 1 mounted on the side of a structure.
Figure 11:
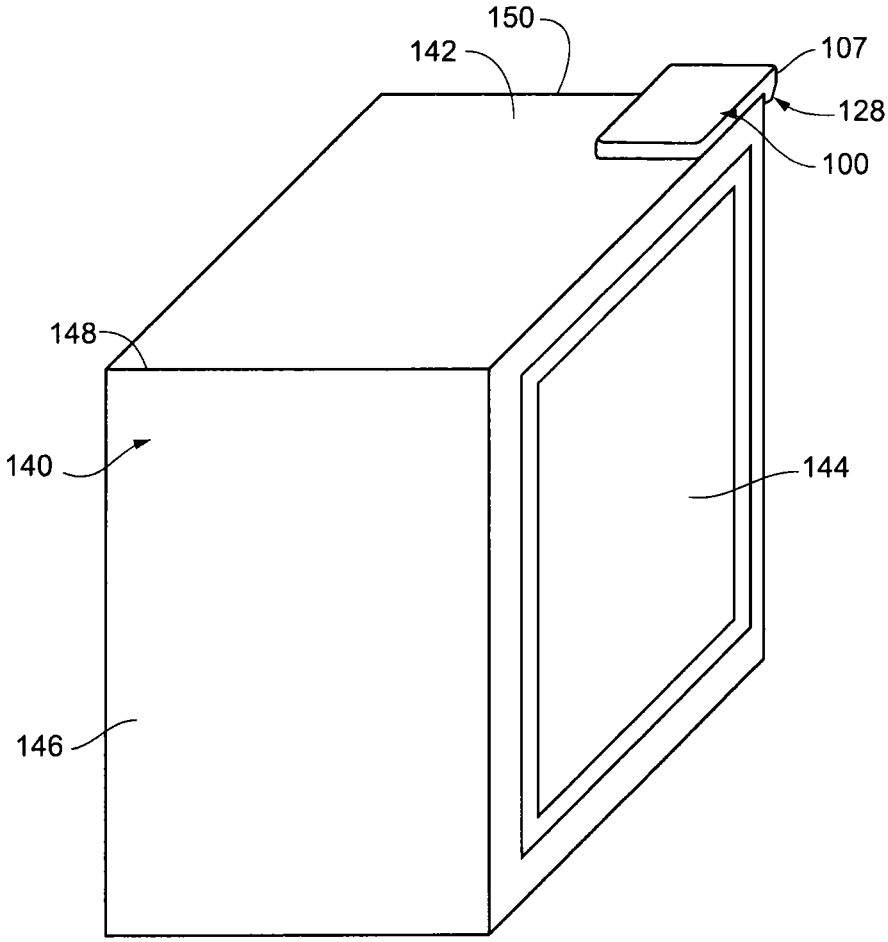
FIG. 11 is a perspective view of the antenna of FIG. 1 mounted on the top of a structure.

Referring to FIGS. 10 and 11, in operation, antenna 100 may be mounted to a structure such as a box-like enclosure of metal or other material. In one application, antenna 100 may be mounted to an enclosure housing utility meters, or other AMR or AMI equipment.

As depicted in FIG. 10, antenna 100 is mounted to enclosure 140 on a side wall surface 146. Enclosure 140 includes top surface 142, front surface 144, side surface 146, first top edge 148 and second top edge 150. In this application, and as depicted, antenna 100 is positioned on surface 146 of enclosure 140. Bottom wall 123 is adjacent enclosure 140 side wall 146, such that bottom surface 124 of bottom portion 116 is adjacent a surface of side wall 146. A hole (not shown) formed in the side wall of enclosure 140 may receive a portion of connector assembly 110, and antenna 100 is secured to enclosure 140 through the hole in enclosure 140, or by other means. An external signal wire may be fed from within enclosure 140 to antenna 100 and connector assembly 110.

Antenna 100 is positioned on enclosure 140 adjacent first top edge 148 such that projection 128 and floating portion 107 of antenna element 106, project beyond side surface 146, and above top surface 142. Antenna 100 is positioned on first top edge 148 such that bottom portion 134 is adjacent top surface 142, while bottom surface 124 is adjacent side surface 146. When positioned in this manner, the planes formed by the top surfaces of ground plane 104 and antenna element 106 are generally parallel to surface 146. Further, the portion of antenna element 106 that extends beyond ground plane 104, floating portion 107, also extends in a vertical direction beyond side surface 146 and top surface 142 by approximately distance OH.

Referring to FIG. 11, in another mounting configuration, antenna 100 is mounted to top surface 142 of enclosure 140. In this configuration, antenna 100 is mounted at second top edge 150 such that floating portion 107 extends beyond top surface 150, and overhangs enclosure 140 by a distance approximately equal to distance OH.

As becomes clear by the mounting configuration depicted in FIGS. 10 and 11, the particular structure of housing 102, including the projection 128, generally requires a user mounting antenna 100 to enclosure 140 to mount it at an edge of enclosure 140. This ensures that a portion of element trace 106 projects beyond enclosure 140. If antenna 100 is not mounted at an edge of enclosure 140, it will be difficult for a user to securely mount antenna 100 to enclosure 140. As such, the structure of projection 128 inherently indicates to a user how to mount antenna 100, at the same time ensures that a portion of antenna element 106 will project into free space.

In operation, antenna 100 functions as a multiband antenna, which in one embodiment means low-band operation in the 900-930 MHz range, and high-band operation in the 2.4-2.5 GHz range. In an alternative embodiment, low-band operation is in the 870-875 MHz range, and high-band operation in the 2.4-2.5 GHz range. Operating at such frequencies is ideal for automated meter reading applications that involve point to point or point to multi point networking, though it will be understood that antenna 100 may be operated at other frequencies, depending on the needs of the particular application. Unlike typical, known patch antennas, antenna 100 operates more or less similar to an omni-directional antenna, in the sense that the gain is less than 3.5 dBi in both the operational bands. Further, the design of antenna 100, and the floating nature of a portion of antenna element 106, provides that antenna 100 operates in a consistent manner, regardless of the surface that it is mounted upon. Which means, the VSWR of the antenna does not change with respect to the contact surface or the environment.

Further, antenna 100 is significantly smaller and more compact as compared to standard monopole, dipole "rubber-ducky", styles of antennas that may be used in similar applications. This allows antenna 100 to be used in space or height-restricted locations, without sacrificing performance, and at the same time, meeting industry requirements.

Figure 12:
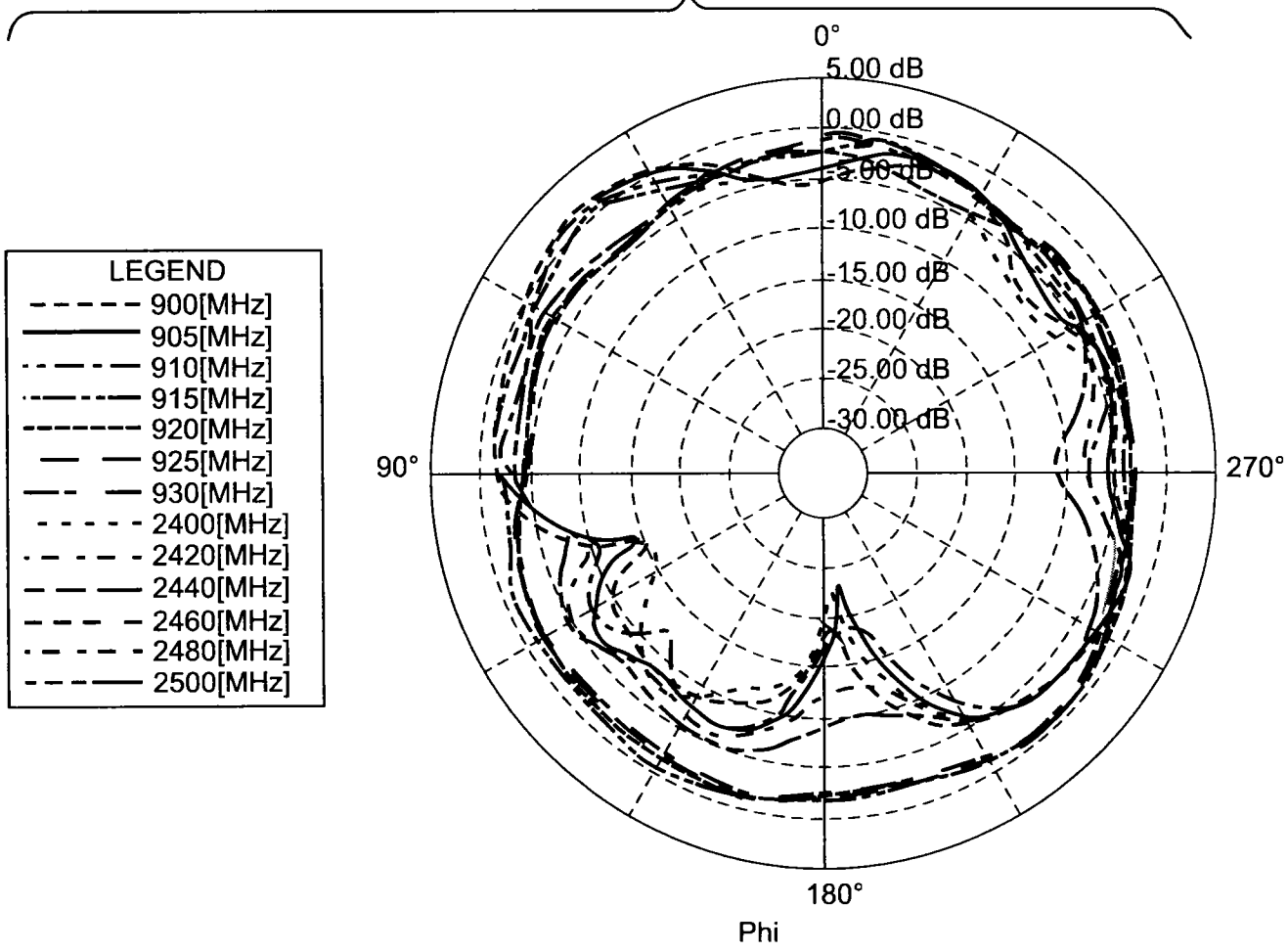
FIG. 12 is a plot of a 3D azimuth gain pattern of the antenna of FIG. 3.
Figure 13:
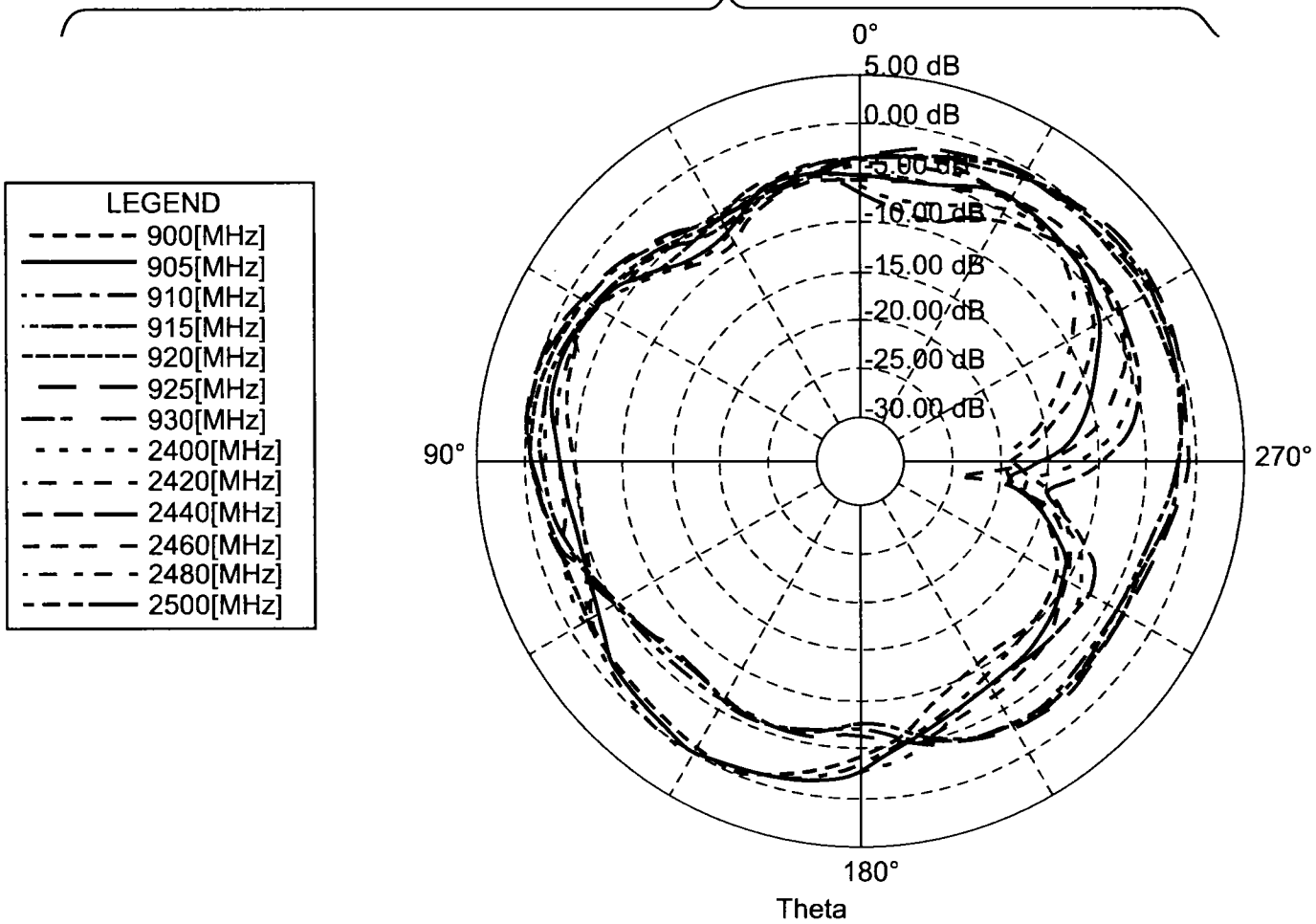
FIG. 13 is a plot of a 3D gain pattern at a first elevation of the antenna of FIG. 3.
Figure 14:
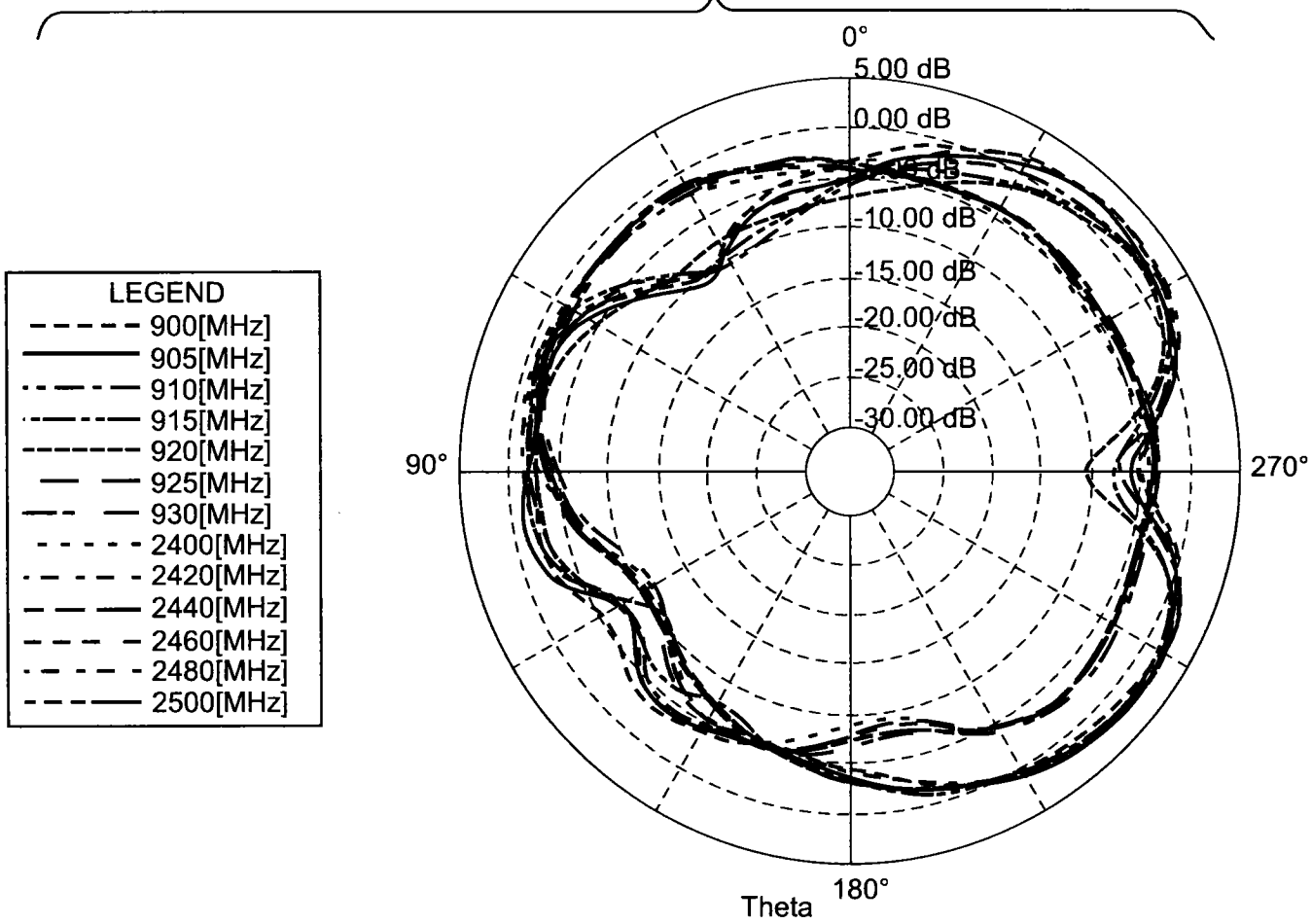
FIG. 14 is a plot of a 3D gain pattern at a second elevation of the antenna of FIG. 3.
Figure 15:
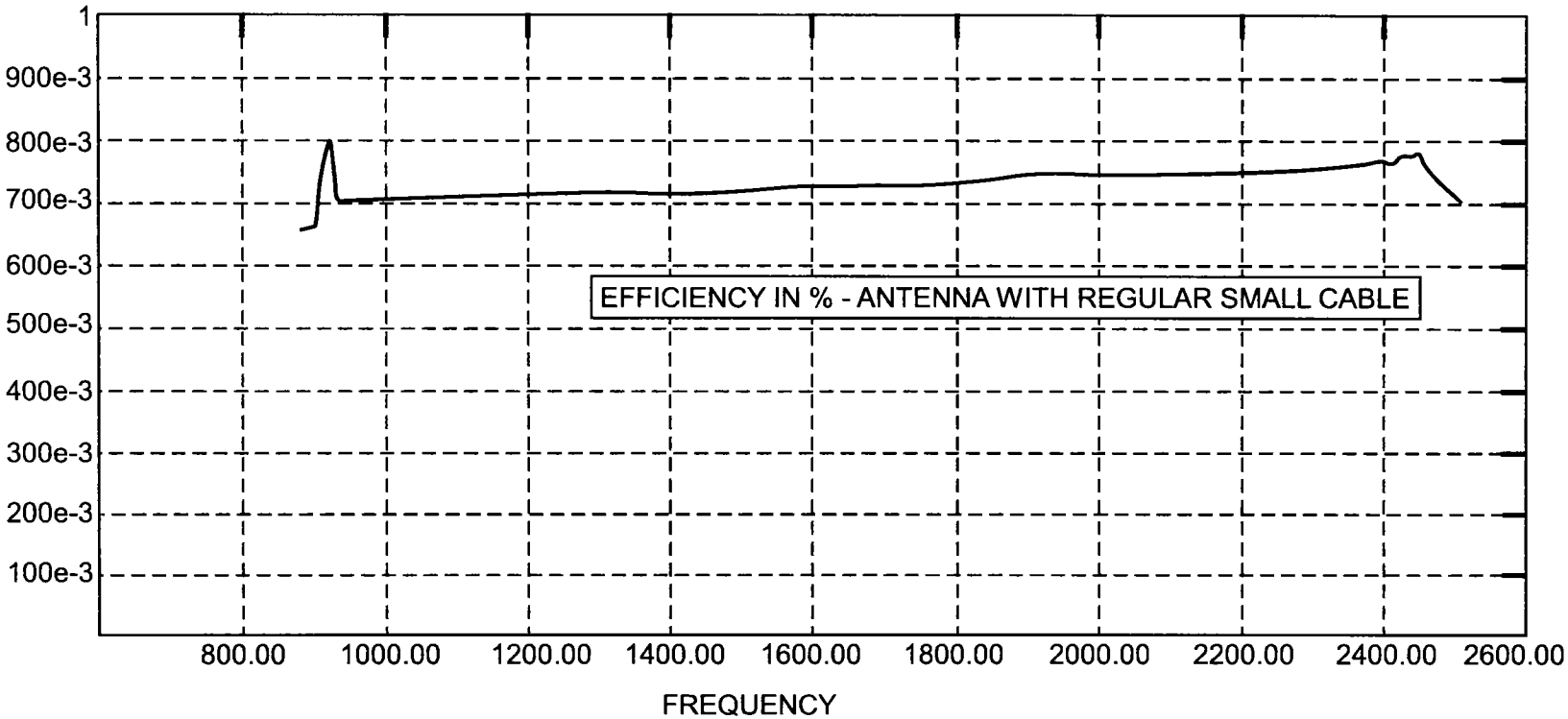
FIG. 15 is an efficiency plot of the antenna of FIG. 1 using a regular small cable.
Figure 16:
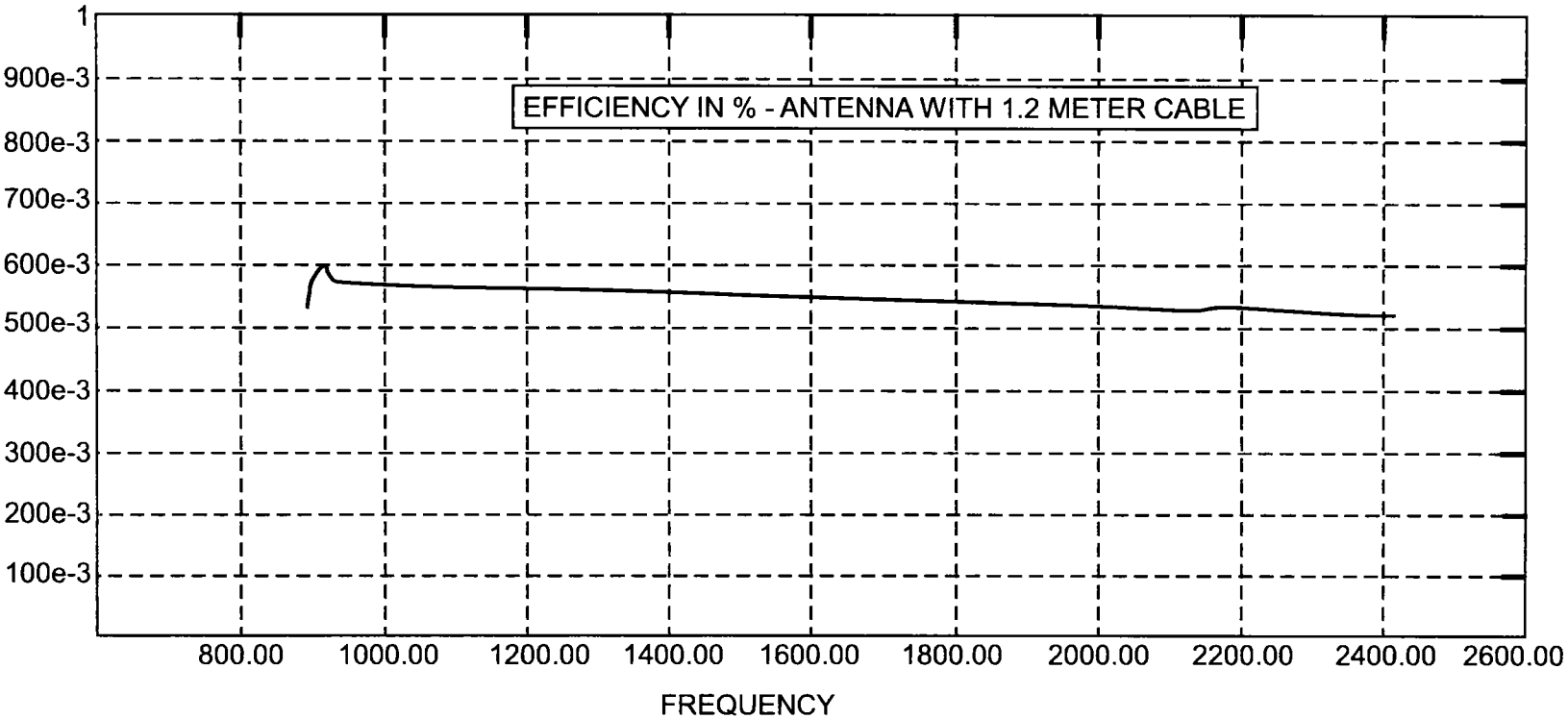
FIG. 16 is an efficiency plot of the antenna of FIG. 1 using a 1.2 m cable.
Figure 17:
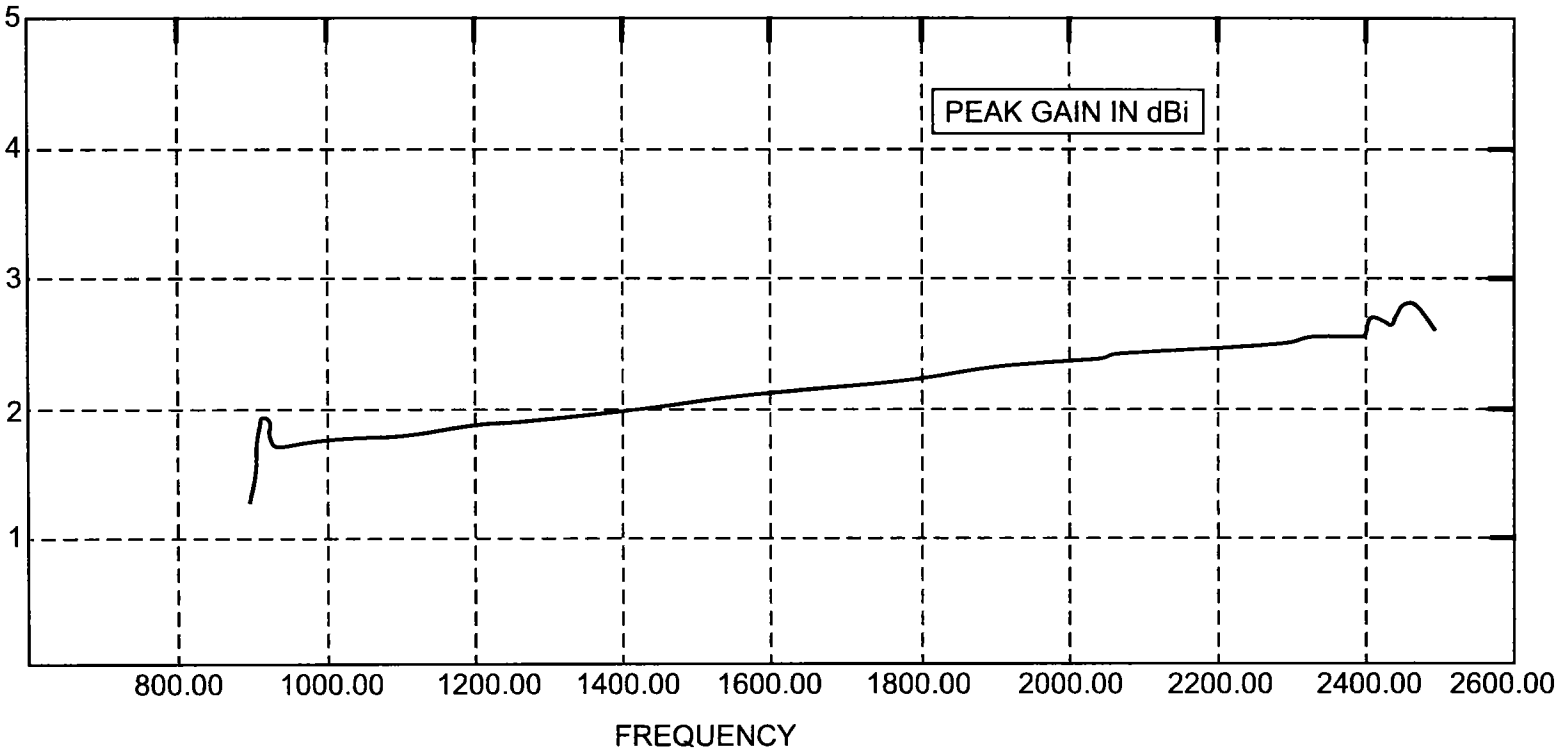
FIG. 17 is an efficiency plot of the antenna of FIG. 1 in dBi.
Figure 18:
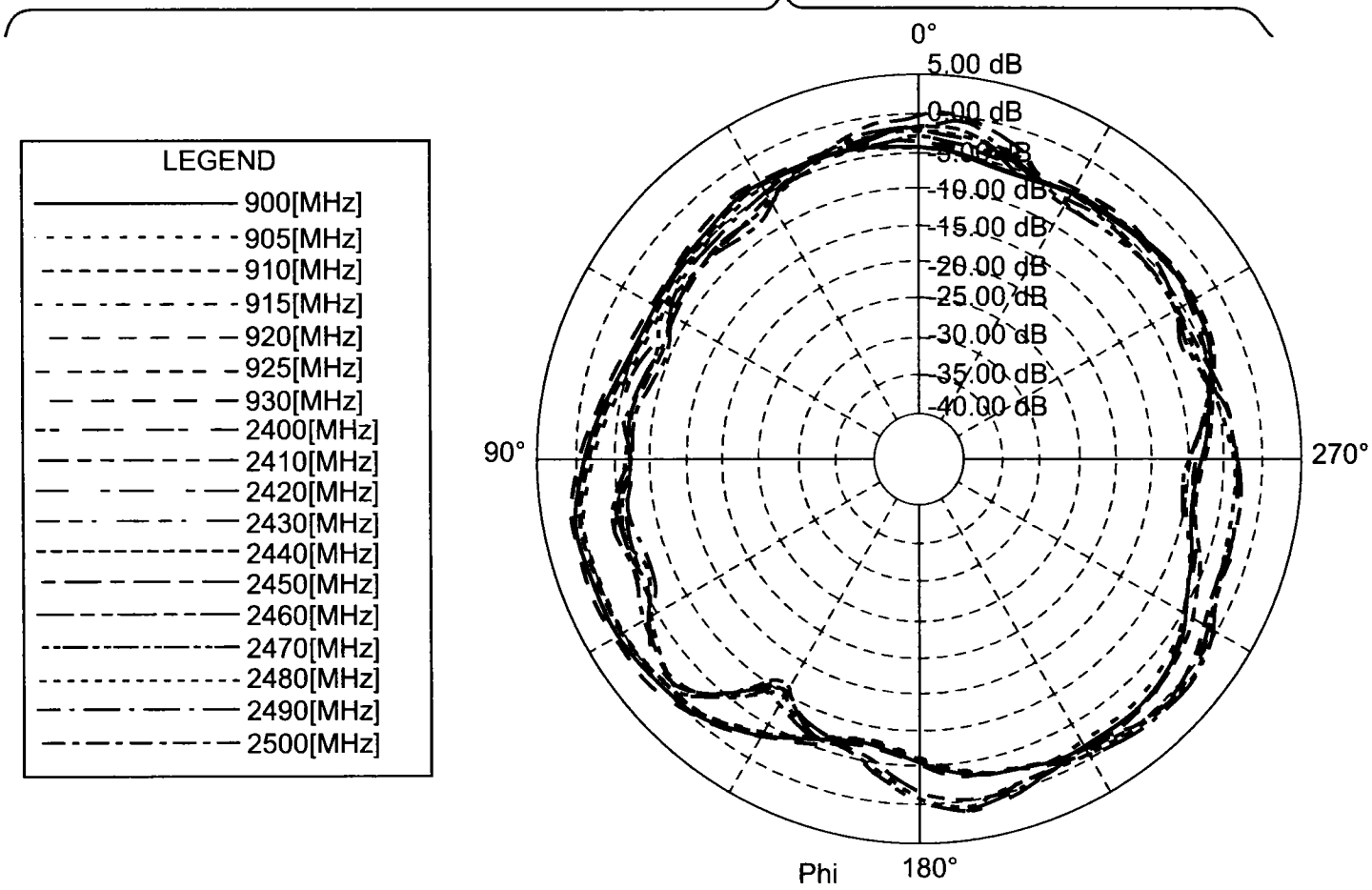
FIG. 18 is a plot of a 3D azimuth gain pattern of the antenna of FIG. 8.
Figure 19:
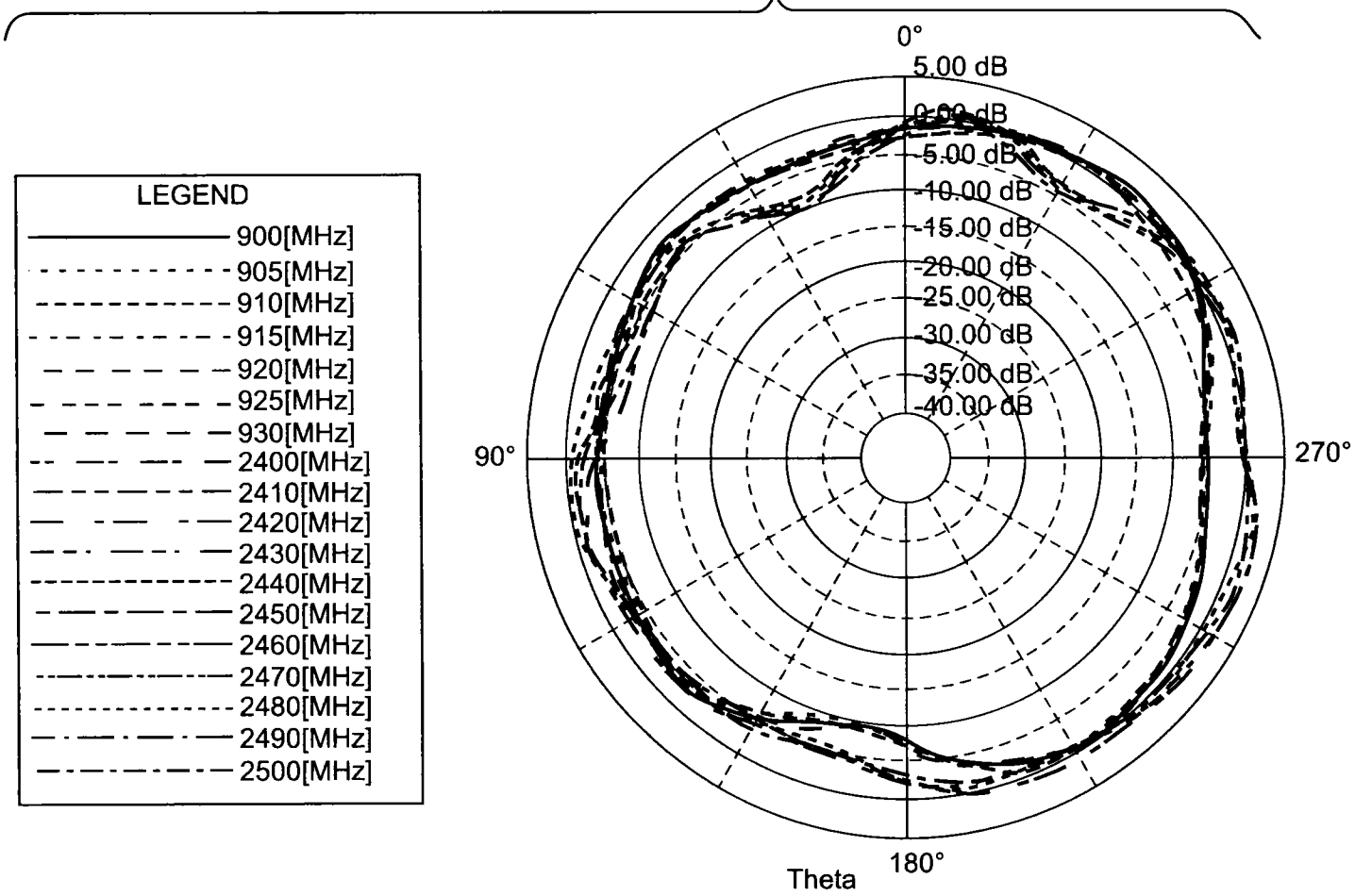
FIG. 19 is a plot of a 3D gain pattern at a first elevation of the antenna of FIG. 8.
Figure 20:
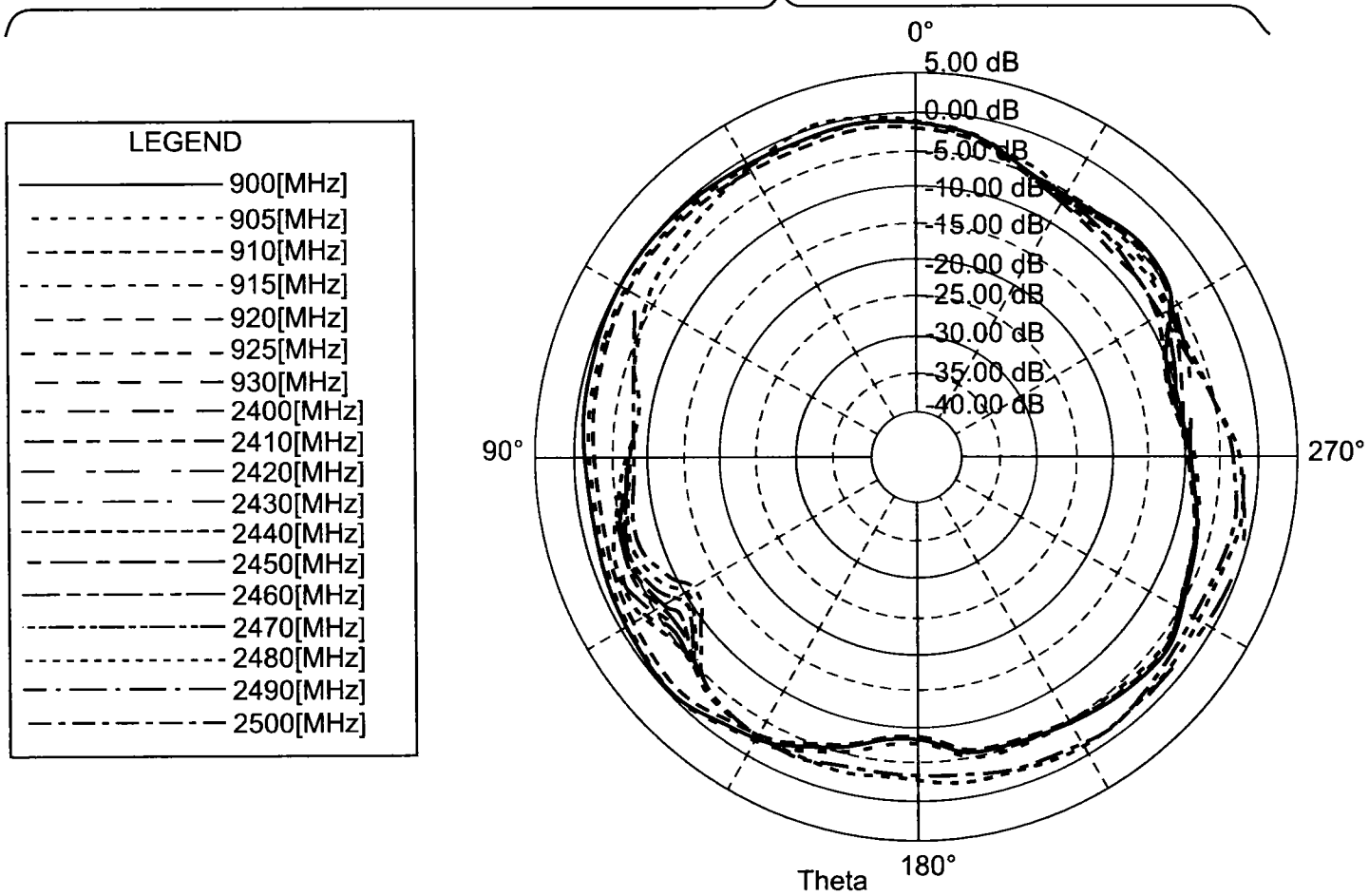
FIG. 20 is a plot of a 3D gain pattern at a second elevation of the antenna of FIG. 8.
Figure 21:
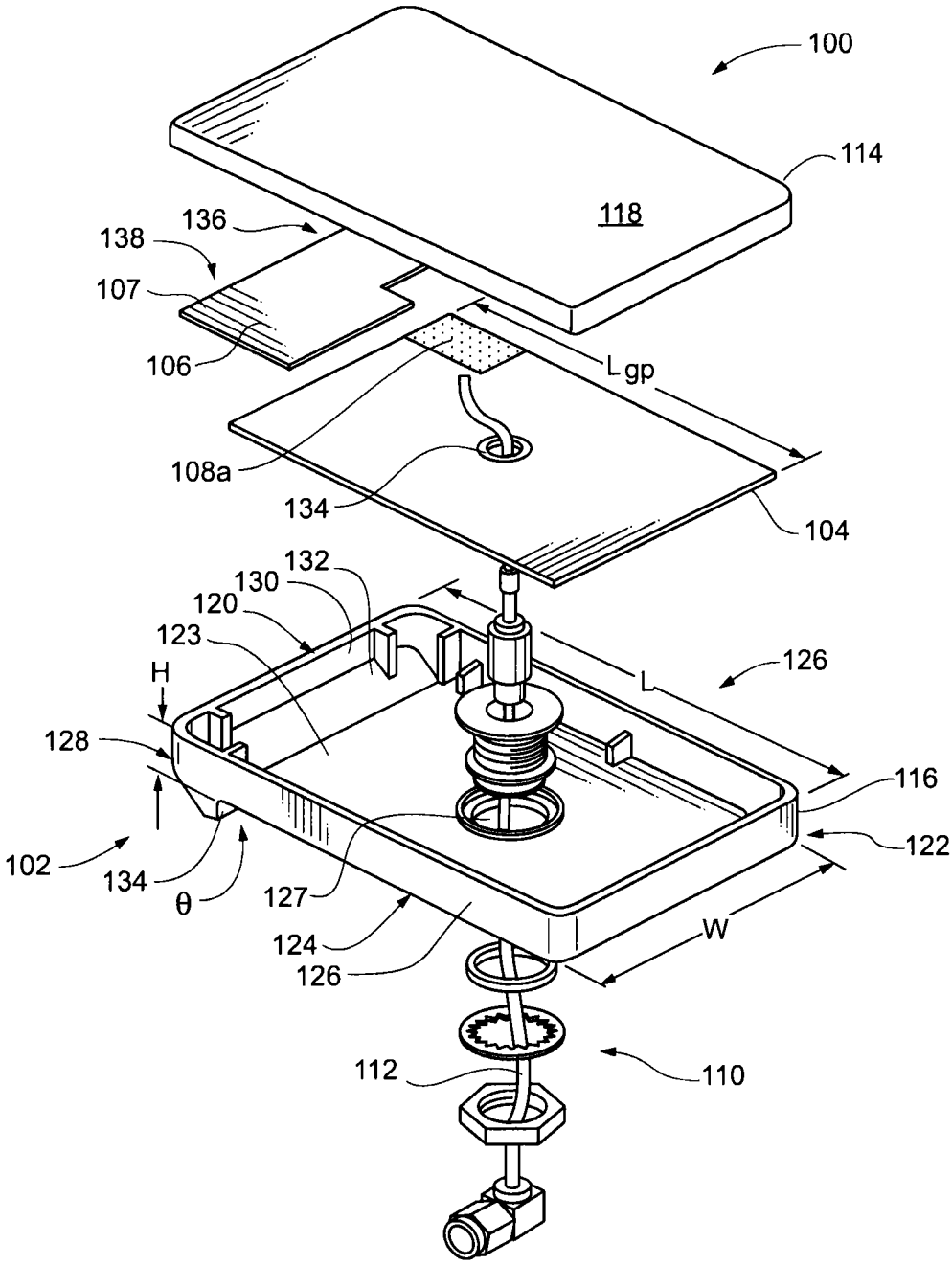
FIG. 21 is an exploded view of another embodiment of the antenna of FIG. 1, including a ground pill.
Figure 22:
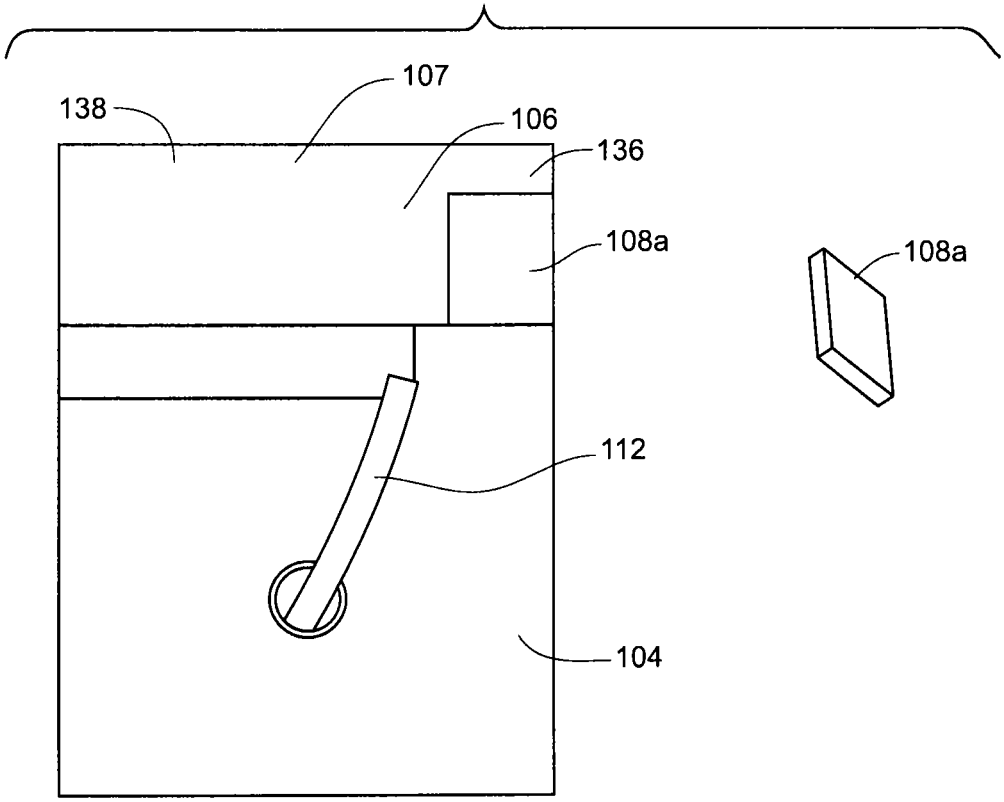
FIG. 22 is a top elevational view of an antenna element positioned over a ground plane and including a ground pill, of the antenna of FIG. 7*a;*

Such performance is illustrated by the 3D gain patterns depicted in FIGS. 12-14, and the efficiency plots depicted in FIGS. 15-17. FIGS. 18-20 depict 3D gain patterns for antenna element 106*a* depicted in FIGS. 8 and 9.

Referring now to FIGS. 21-24, in another embodiment of antenna 100, performance can be enhanced through the use of a ground pill. In the depicted embodiment, support coupler 108 includes a ground pill 108*a*, which in one embodiment is a rectangular metal structure that provides structural support for antenna element 106 and at the same time, capacitively couples a portion of antenna element 106 with ground plane 104. In an embodiment, ground pill 108*a* can be 8 mm wide by 15 mm long, though the exact dimensions may vary depending on the desired operating characteristics of antenna 100, including operating frequencies, desired gains, power requirements, and so on. Further, though in the depicted embodiment ground pill 108*a* comprises a conductive, metal material; other materials can be used, including other dielectric materials, such that the capacitive coupling effect between antenna element 106 and ground plan 104 is enhanced as needed.

In the depicted embodiment, ground pill 108*a* is located beneath high band arm 136 of antenna portion 106, and above ground plane 104. Ground pill 108*a* is affixed to ground plane 104 and to antenna element 106 such that it provides structural support with or without an additional support coupler 108 as described previously.

In operation, the capacitive coupling effect of ground pill 108*a* on high-band arm 136 and ground plane 104 enhances the surface-independent nature of antenna 100 in the high-frequency range of operation, such that antenna 100 operates consistently, regardless of the surface material onto which it is mounted. A further benefit of the ground-pill embodiment of antenna 100 is a reduction in overall size, without sacrificing gain or efficiency characteristics. A further benefit of the ground-pill embodiment of antenna 100 is that the peak gain of the antenna can be controlled in the high band.

Figure 23:
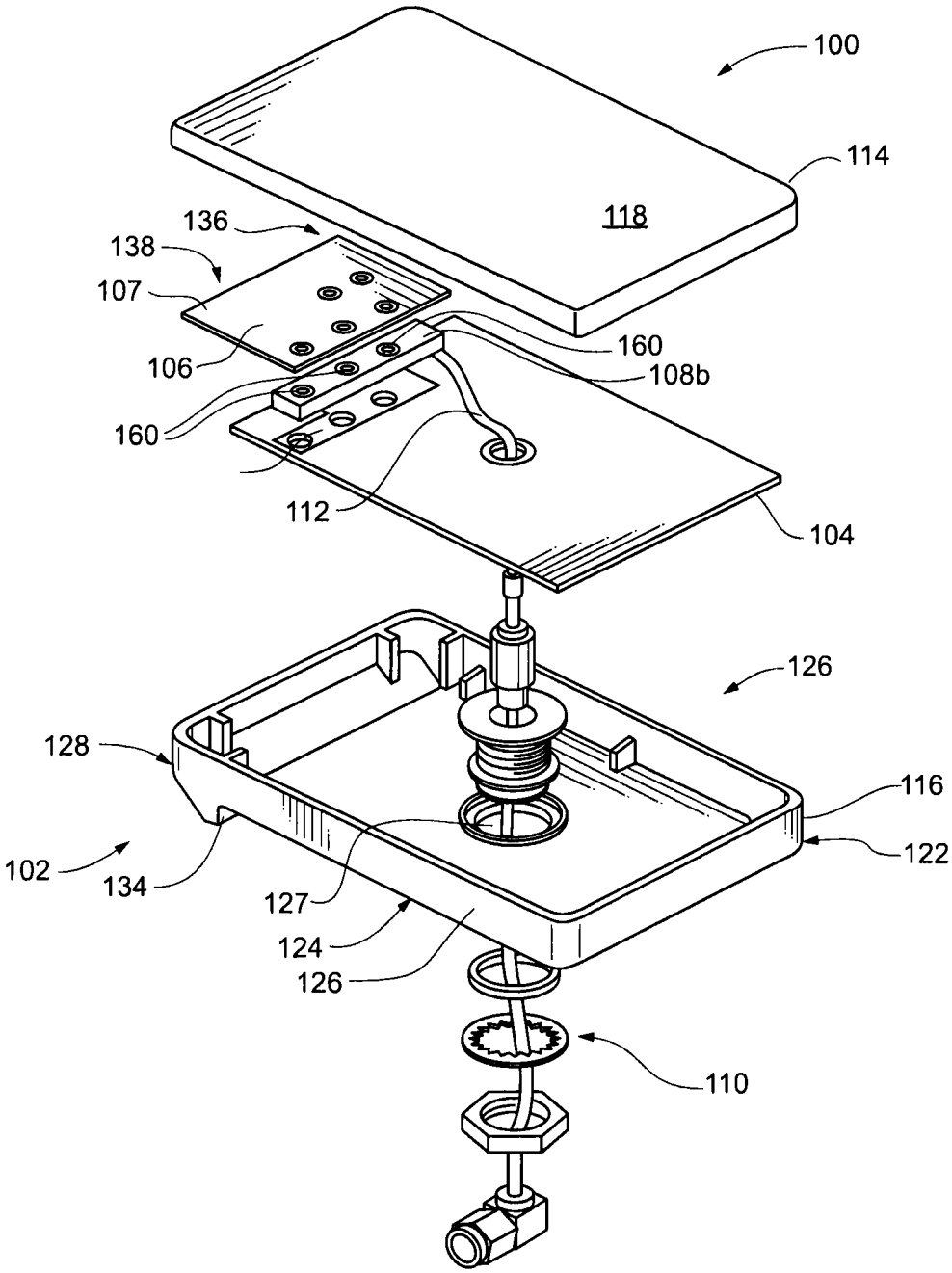
FIG. 23 is an exploded view of another embodiment of the antenna of FIG. 1, including a via block over a ground plane according to an embodiment of the invention.

Referring to FIG. 23, in another embodiment, antenna 100 includes a support coupler 108 which includes via block 108*b*. Similar to ground pill 108*a*, via block 108*b* comprises a block-like structure that provides support to antenna element 106, and provides capacitive coupling between antenna element 106 and ground plane 104. However, unlike ground pill 108*a*, via block 108*b* comprises two different materials with differing electrical properties, and is designed to enhance the low-band operation of antenna 100.

More specifically, via block 108*b* comprises a conductive or dielectric material forming multiple, vertical vias 160, or channels, that capacitively couple portions of low-band arm 138 of antenna 106 with ground plane 104. The non-via portions of via block 108*b* may comprise an insulating, or other non-conductive material that surrounds and supports vias 160, as well as antenna 106.

In one embodiment ground pill 108*a* has dimensions of approximately 11.75 mm wide by 8.5 mm long by 2.8 mm in height. In various embodiments the dimensions can vary by +/−1 mm. In this embodiment ground pill 108*a* does not come into contact with ground plane 104. Ground pill 108*a* is located under the high band arm of the antenna. This configuration can help to stabilize the high band of the antenna 100 and contribute to making the antenna perform as desired independent of the mounting surface.

Vias 160 can be distributed about via block 108*b* such that low-band arm 138 of antenna 106 is capacitively coupled to ground plane 104 at distributed, multiple locations, without capacitively coupling the entire low-band arm 138. Vias 160 do not directly contact the conductive portions of antenna element 106, such that the one or more vias act in a purely capacitive manner. The depicted particular antenna has about 5 via, each one bears a fraction of the coupling effect. The larger the via size the stronger the coupling effect. If they get too large or come too close to the antenna trace then the via can have an adverse effect.

In some embodiments, such as those depicted in FIGS. 24-25, and 25*a-d*, support coupler 108 can include a simple, non-conductive shim 108*c* for supporting antenna element 106, and a ground pill 108*a* for supporting and capacitively coupling high-band arm 136 to ground plane 104. The non-conductive shim 108*c* can include holding pins 162 that align the ground plane 104 to the antenna element 106. In various embodiments that shim 108*c* can separate the antenna element 106 from the ground plane 104 by a distance of approximately two to four mm. In one embodiment the distance between the antenna element 106 from the ground plane 104 is three mm. In one embodiment the antenna element 106 and the ground plane 104 comprise PCB boards with a thickness of approximately 31 mils. As known in the art PCB boards with alternative thicknesses are also contemplated.

Figure 7B:
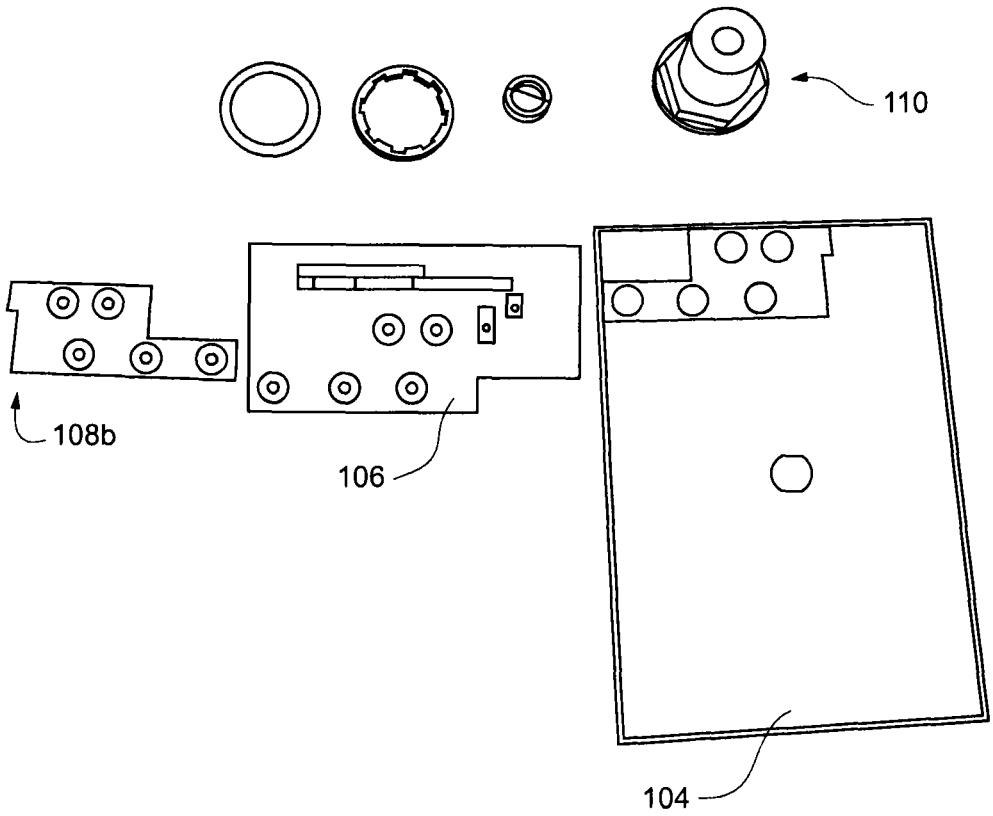
FIG. 7*b* is a top view of connector assembly components, a via block, an antenna element, and a ground plane according to an embodiment of the invention.

In one embodiment, support coupler 108 can or may include a via block 108*b* having via 160 (as depicted in FIG. 7*b*) for supporting and selectively capacitively coupling low-band arm 138 to ground plane 104. In other embodiments, support coupler 108 may comprise a combination of a simple support shim, ground pill 108*a*, or via block 108*b*, such that the surface-independent characteristics are enhanced across all operating bands.

Figure 26:
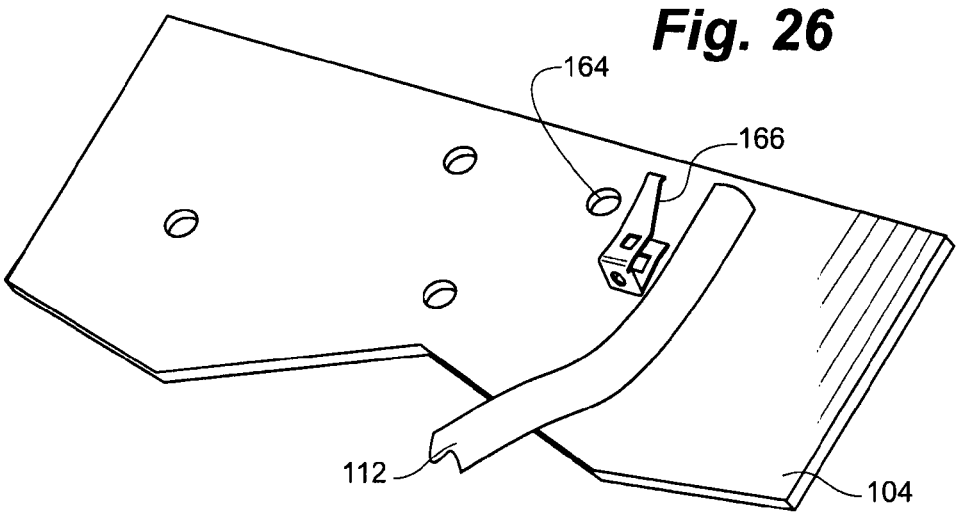
FIG. 26 is a perspective view of a spring contact pin on a ground plane of an antenna according to an embodiment of the invention.

FIG. 26 depicts an embodiment of ground plane 104 with a spring contact pin 166 that connects antenna element 106 to the ground copper on the lower PCB that forms ground plane 104. In one embodiment the spring contact pin 166 connects the antenna trace of antenna element 106 to the ground plane 104. Spring contact pin 166 can comprise any appropriate conductive metal and configured in a shape that supplies physical tension between the ground plane 104 and the antenna element 106 sufficient to maintain contact between the two PCB boards that comprise the ground plane 104 and the antenna element 106. Spring contact pin 166 can include mounting openings 167 that can connect the spring contact pin 166 to any of a variety of shims, for example non-conductive shim 108*c* as depicted in FIG. 25*a-d*. As depicted in FIG. 26, ground plane 104 can also include through holes 164 configured to mate with holding pins 162 of shim 108*c*.

In one embodiment the spring contact pin 166 is conductive and connects the antenna trace on the top board antenna element 106 to the ground of the antenna on the bottom board ground plane 104. The upper portion of spring contact pin 166 connects to the antenna trace and the lower portion of spring contact pin 166 connects the ground plane 104. When the boards are assembled together with a shim, such as another PBC layer or a Teflon spacer, the components tightly fit together and maintain electrical contact through the spring contact pin 166. The contact point at which the Antenna Trace Loops back and connects to the ground plane can determine the existence of two resonances (one in Low-band and one in High-band) and also the depth of the resonances, i.e., the voltage standing wave ratio (VSWR). If the contact point moves away or towards the ground, it can change or disrupt the optimal resonance criterion for the antenna. The antenna can lose its dual band nature if the contact point is not appropriately located.

Figure 27:
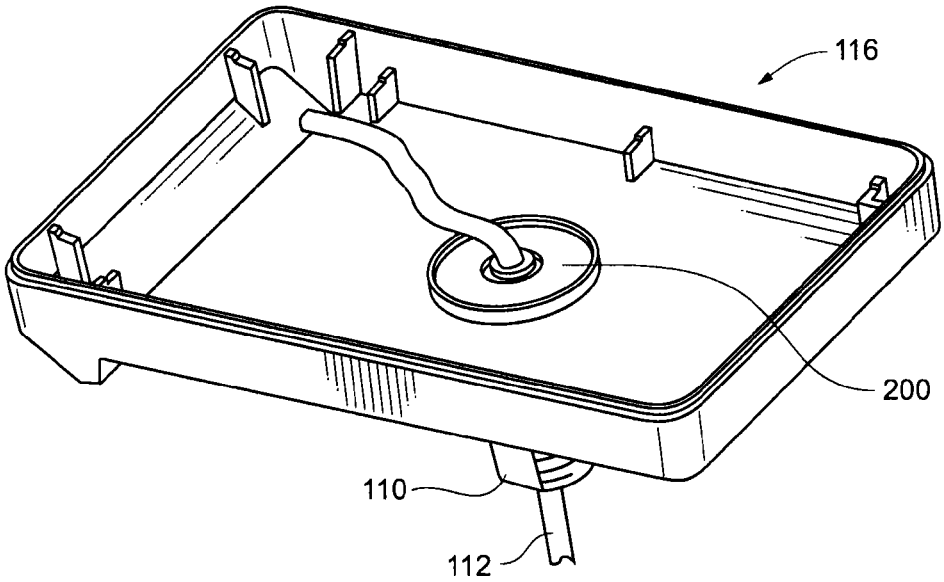
FIG. 27 is a perspective view of a bottom housing with a metal mount according to an embodiment of the invention.

FIG. 27 depicts an embodiment of connector assembly 110 which includes a metal mount 200 that secures cable containing signal wire 112 to bottom housing 116. The metal mount 200 can function as a mounting mechanism to secure the antenna 100 to a surface such as those depicted in FIGS. 10 and 11, and for guiding the signal wire 112 cable into the assembly.

In one embodiment the metal mount 200 is not part of the antenna ground plane 104 and does not electrically connect to the antenna or the ground plane in any fashion. By isolating the mount from the antenna the antenna becomes immune to, or does not change, its characteristics based on the type of surface it's mounted to or that the metal mount connects to. Therefore, the antenna can function the same on metallic or non-metallic surfaces.

Figure 28:
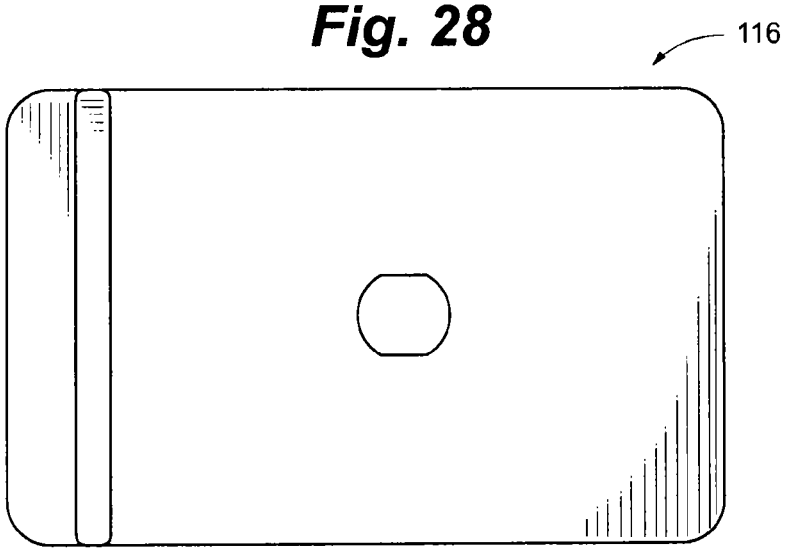
FIGS. 28-29 depict an exemplary embodiment of a bottom housing of the antenna of FIG. 1, according to an embodiment of the invention.
Figure 29:
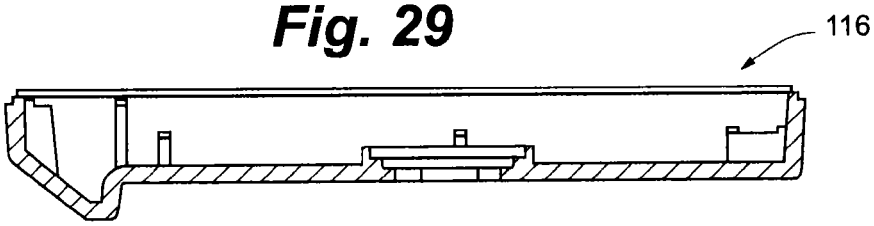
Figure 30:
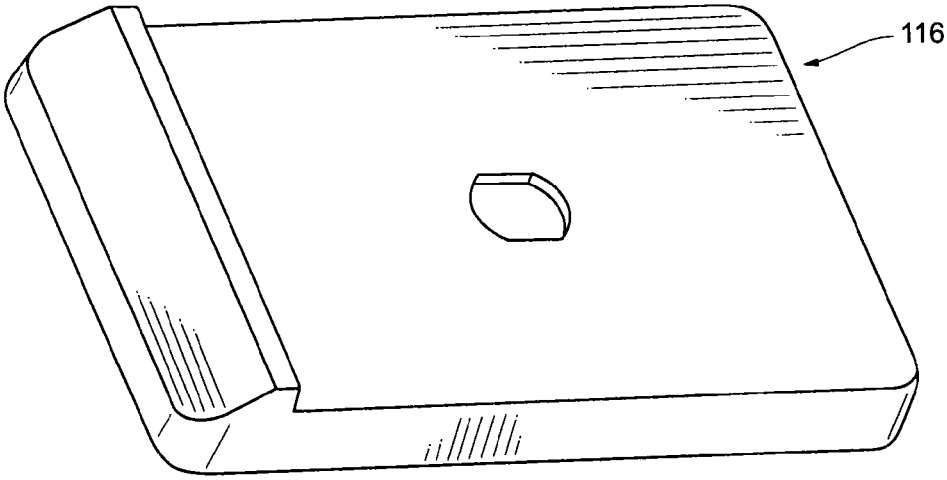
FIG. 30 depicts a perspective view of an embodiment of a bottom housing of the antenna of FIG. 1, according to an embodiment of the invention.

FIG. 28 depicts bottom view of an exemplary embodiment of bottom housing 116. FIG. 29 depicts a cut away side view of the bottom housing 116 of FIG. 28. FIG. 30 depicts a perspective view of an exemplary embodiment of bottom housing 116 of FIG. 28.

Figure 24:
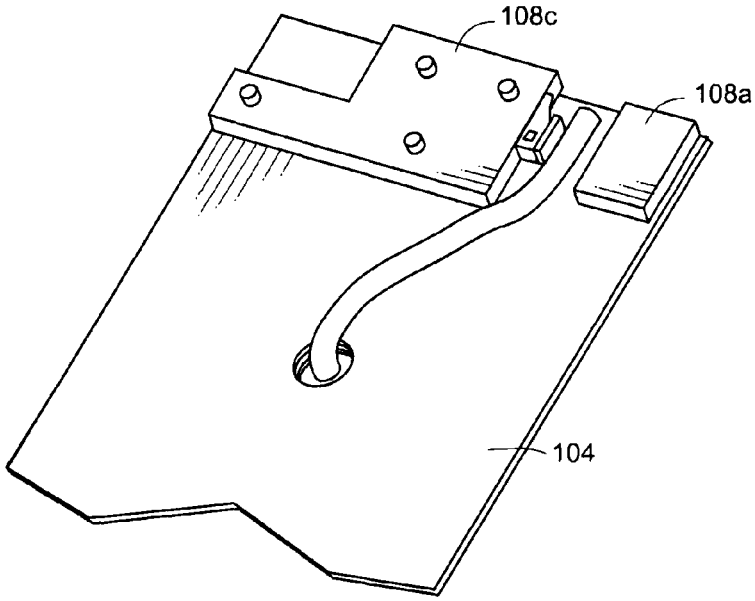
FIG. 24 is a perspective view of a ground pill and a via block over a ground plane according to an embodiment of the invention.
Figure 25:
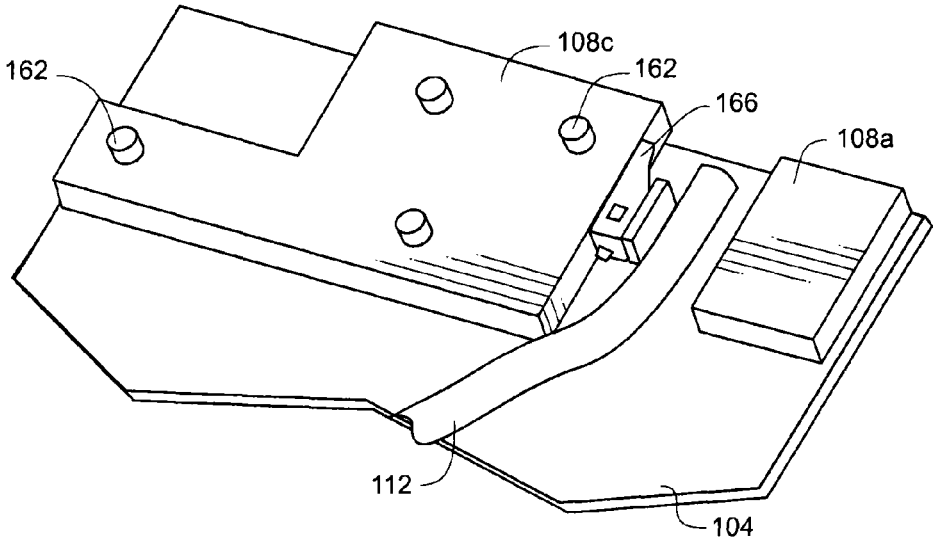
FIG. 25 is another perspective view of the embodiment of the antenna of FIG. 24.
Figure 25A:
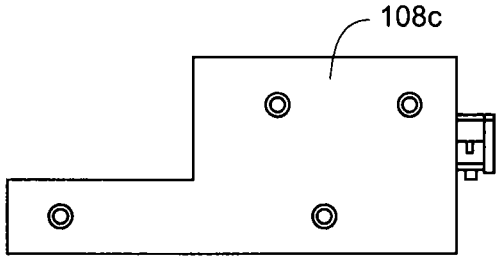
FIG. 25*a-d* depict top, side, front and perspective views of a non-conductive support shim, according to an embodiment of the invention.
Figure 25B:
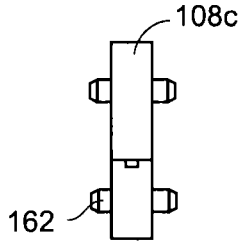
Figure 25C:
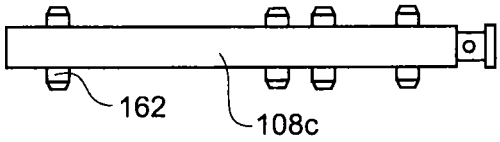
Figure 25D:
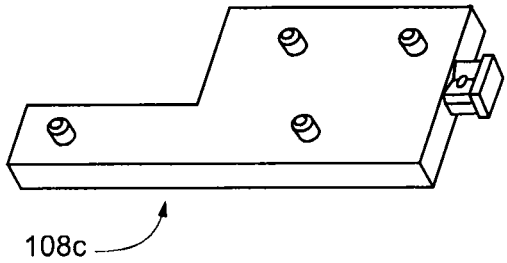
Figure 31A:
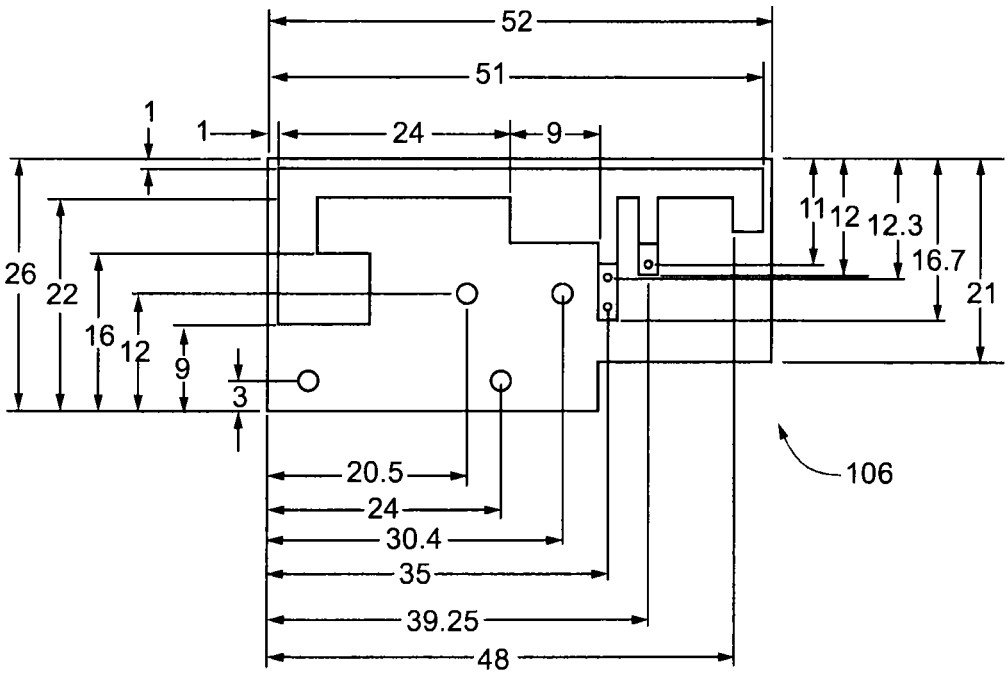
FIGS. 31*a* and 31*b* are a top view of an antenna trace disposed on an antenna element, according to an embodiment of the invention.
Figure 31B:
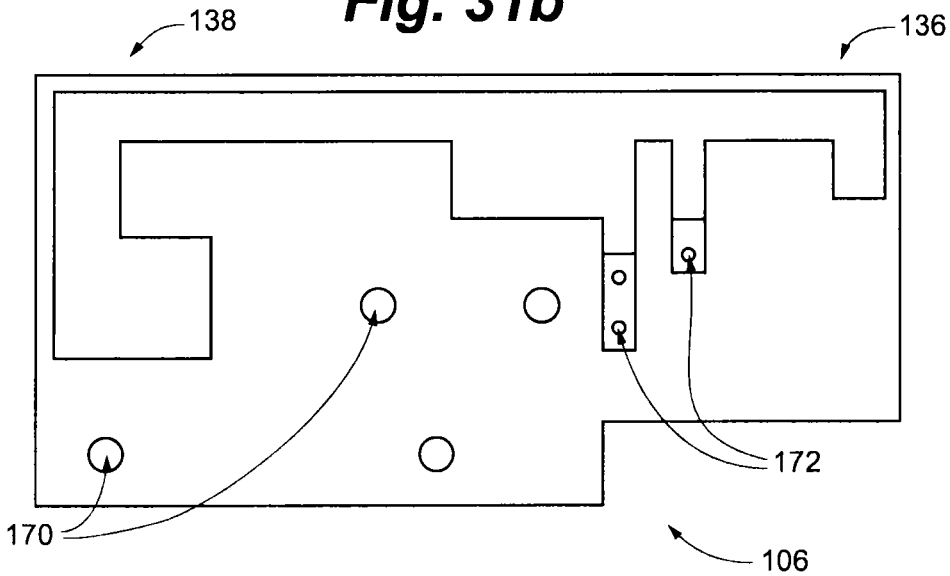

FIGS. 31*a* and 31*b* depict an embodiment of antenna element 106 with both a high-band arm 136 and a low-band arm 138. The dimensions depicted in FIG. 31*a* are by way of example only and should not be considered limiting. The depicted antenna element 106 includes a plurality of through holes 170 that can mate with holding pins 162 of shim 108*c* as depicted in FIGS. 24 and 25. In an alternative embodiment antenna element 106 can be mounted above a via block 108*b* PCB configured with a plurality of vertical via 160 as depicted in FIG. 23. Because, the low-band arm 138 is longer in length than the high-band arm 136 a more distributive effect, or an analogous "ground pill" effect, is instead accomplished by the multiple vias instead of a single one point/region of a ground pill 108*a*. The series of distributed vias does not directly contact the trace that forms the low-band arm 138.

In one embodiment both a high-band arm 136 and a low-band arm 138 can be electrically connected with signal wire 112 by attaching the signal wire 112 to one or more conductive post or vias 172 that pass through the entire thickness of antenna element 106, providing an electrical contact for signal wire 112 and/or spring contact pin 166 to electrically connect to the antenna trace arm(s).

Although the present invention has been described with respect to the various embodiments, it will be understood that numerous insubstantial changes in configuration, arrangement or appearance of the elements of the present invention can be made without departing from the intended scope of the present invention. Accordingly, it is intended that the scope of the present invention be determined by the claims as set forth.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A surface-independent, conformal antenna for mounting to an exterior of an enclosure having a mounting surface with an edge, comprising:

a ground plane having an outer perimeter;

an antenna element having a floating portion and a non-floating portion, wherein the non-floating portion is affixed in a generally parallel orientation above an end of the ground plane, and the floating portion extends beyond the outer perimeter of the ground plane;

a housing including a top portion and a bottom portion, the housing sized to generally encapsulate the ground plane and the antenna element, the bottom portion of the housing including a major flat surface oriented generally parallel with the ground plane and a projection that protrudes from the major flat surface along a direction perpendicular to the ground plane, the projection being situated in a vicinity of the floating portion;

wherein the major flat surface defines an opening in the housing sized to accept a feeder line electrically coupled to the antenna element; and wherein the major flat surface and the projection are further oriented such that, when the major flat surface is situated against the mounting surface in a mounting configuration, the projection is situated beyond the edge of the mounting surface;

wherein the antenna operates consistently and independently of a material of the mounting surface.

2. The antenna of claim 1, wherein the projection forms a space to receive the floating portion of the antenna element.

3. The antenna of claim 1, further comprising a non-conductive shim disposed between the ground plane and the non-floating portion of the antenna element.

4. The antenna of claim 3, wherein the non-conductive shim includes a plurality of posts configured to mate with a corresponding plurality of holes in the ground plane.

5. The antenna of claim 3, wherein the non-conductive shim includes a plurality of posts configured to mate with a corresponding plurality of holes in the antenna element.

6. The antenna of claim 1, wherein the antenna element further comprises an antenna trace having a high-band arm and a low-band arm.

7. The antenna of claim 1, further comprising a via block including at least one via oriented generally perpendicular to the antenna element, the via block further including a bulk material situated between the antenna element and the ground plane to support the antenna element.

8. The antenna of claim 7, wherein the via block includes a conductive material.

9. The antenna of claim 7, wherein the bulk material of the via block includes a dielectric material, and wherein the vias are formed from a conductive material and are embedded in the bulk material.

10. The antenna of claim 7, wherein each one of the at least one via of the via block capacitively couples a specific portion of the antenna element with the ground plane.

11. The antenna of claim 1, further comprising a ground pill attached to the ground plane.

12. The antenna of claim 11, wherein the ground pill is located beneath a high-band arm of the antenna element.

13. The antenna of claim 11, wherein the ground pill comprises a conductive metal material.

14. The antenna of claim 11, wherein the ground pill comprises a dielectric material.

15. The antenna of claim 1, further comprising a spring contact pin disposed on the ground plane and in spring tension contact with an antenna trace of the antenna element.

16. A surface-independent, conformal antenna for mounting to a mounting surface, comprising:

a ground plane having an outer perimeter;

an antenna element having a floating portion and a non-floating portion, including an antenna trace having a high-band arm and a low-band arm, wherein the non-floating portion is affixed in a generally parallel orientation above an end of the ground plane, and the floating portion extends beyond the outer perimeter of the ground plane;

a via block disposed between the ground plane and the antenna element and providing mechanical support between the ground plane and the antenna element, the via block including at least one via embedded in a non-conductive bulk material, the at least one via oriented generally perpendicular to the antenna element, wherein the at least one via is in non-contact proximity to the low-band arm of the antenna trace so as to provide capacitive coupling between a corresponding specific portion of the low-band arm and the ground plane;

a ground pill attached to the ground plane in non-contact proximity to the high-band arm of the antenna trace so as to provide capacitive coupling between a corresponding specific portion of the high-band arm and the ground plane;

a housing including a top portion and a bottom portion, the housing sized to generally encapsulate the ground plane and the antenna element, and wherein the bottom portion of the housing includes a projection forming a space to receive the floating portion of the antenna element; and wherein the antenna operates consistently and independently of a material of the mounting surface.

17. The antenna of claim 16, wherein the at least one via of the via block includes a plurality of vias situated at various points along the a length of the low-band arm.

* * * * *